US007767111B2

(12) United States Patent
Nakazawa

(10) Patent No.: US 7,767,111 B2
(45) Date of Patent: Aug. 3, 2010

(54) SURFACE CONDITIONER AND METHOD OF SURFACE CONDITIONING

(75) Inventor: Toshiko Nakazawa, Tokyo (JP)

(73) Assignee: Nippon Paint Co., Ltd., Osaka (JP)

( * ) Notice: Subject to any disclaimer, the term of this patent is extended or adjusted under 35 U.S.C. 154(b) by 581 days.

(21) Appl. No.: 11/062,228

(22) Filed: Feb. 18, 2005

(65) Prior Publication Data

US 2005/0187326 A1 Aug. 25, 2005

(30) Foreign Application Priority Data

Feb. 20, 2004 (JP) ..... 2004-044563

(51) Int. Cl.
*C23F 11/00* (2006.01)
*C23C 22/78* (2006.01)

(52) U.S. Cl. ..... 252/389.2; 252/387; 252/389.52; 148/254

(58) Field of Classification Search ..... 252/387, 252/389.52
See application file for complete search history.

(56) References Cited

U.S. PATENT DOCUMENTS

| | | | | | |
|---|---|---|---|---|---|
| 3,898,037 | A * | 8/1975 | Lange et al. | 422/16 |
| 4,110,117 | A * | 8/1978 | McLeod | 106/1.17 |
| 4,640,793 | A * | 2/1987 | Persinski et al. | 252/180 |
| 4,818,783 | A * | 4/1989 | Shioji et al. | 524/425 |
| 5,057,597 | A * | 10/1991 | Koskan | 528/328 |
| 5,292,908 | A * | 3/1994 | Onikata et al. | 556/173 |
| 5,320,673 | A * | 6/1994 | Carpenter | 106/404 |
| 5,453,416 | A * | 9/1995 | Thevissen | 507/224 |
| 5,837,776 | A * | 11/1998 | Selvarajan et al. | 525/244 |
| 5,980,619 | A * | 11/1999 | Braig et al. | 106/14.12 |
| 6,239,194 | B1 * | 5/2001 | Standke et al. | 523/200 |
| 2002/0007769 | A1 * | 1/2002 | Yoshioka et al. | 106/403 |
| 2004/0011429 | A1 * | 1/2004 | Miyamoto et al. | 148/254 |
| 2004/0091963 | A1 * | 5/2004 | McMurray et al. | 435/69.1 |
| 2004/0107867 | A1 * | 6/2004 | Gallagher et al. | 106/14.44 |

FOREIGN PATENT DOCUMENTS

| | | |
|---|---|---|
| CN | 1470672 | 1/2004 |
| EP | 1 378 586 | 1/2004 |
| JP | 59-226181 | 12/1984 |
| JP | 63-157878 | 6/1988 |
| JP | 10-245685 | 9/1998 |
| JP | 2000-96256 | 4/2000 |
| JP | 2001-089869 | 4/2001 |
| WO | WO-98/39498 | 9/1998 |
| WO | WO-00/05066 | 2/2000 |

OTHER PUBLICATIONS

Garris, J.P.; Sikes, C.S. Colloids and Surfaces A: Physicochemical and Engineering Aspects, 1993 (80) 103-112.*

* cited by examiner

*Primary Examiner*—Mark Eashoo
*Assistant Examiner*—Peter F Godenschwager
(74) *Attorney, Agent, or Firm*—Jordan and Hamburg LLP

(57) ABSTRACT

A surface conditioner contains zinc phosphate particles of $D_{50}$ of 3 μm or less and has a pH of 3 to 12, and also contains at least one of (1) carboxylate group-containing copolymers obtained by copolymerizing a monomer composition containing at least one species selected from acrylic acid, maleic acid, maleic anhydride, itaconic acid and itaconic anhydride in an amount less than 50% by weight and at least one species selected from the group consisting of a sulfonic acid monomer, styrene, olefin monomers, amino group-containing monomers and certain polyoxyalkylene derivatives, (2) certain polyamino acids, and (3) certain phosphate esters.

4 Claims, 5 Drawing Sheets

SURFACE CONDITIONER AND METHOD OF SURFACE CONDITIONING

TECHNICAL FIELD

The present invention relates to a surface conditioner and a method of surface conditioning.

BACKGROUND ART

Automobile's bodies, household electrical appliances or the like are commercialized by forming metal moldings from metal materials such as a steel sheet, a galvanized steel sheet, an aluminum alloy or the like, coating and assembling. Coating of such metal moldings are conducted after performing various steps such as degreasing, surface conditioning, chemical conversion treatment, and electrodeposition.

Surface conditioning is a treatment applied in such a way that a coat comprising phosphate crystals is formed uniformly and quickly with a high density on the whole surface of metal in chemical conversion treatment of a phosphate coat of the subsequent step, and a treatment in which crystal nuclei of phosphate are generally formed on the metal surface by immersing a metal in a surface conditioning tank.

For example, in Japanese Kokai Publication Hei-10-245685, there is disclosed a pretreatment solution for conditioning a surface before applying chemical conversion treatment of a metal phosphate coat, which contains one or more species selected from phosphate containing at least one species of bivalent or trivalent metals including fine particles having a particle diameter of 5 μm or less, alkali metal salt or ammonium salt or a mixture thereof and at least one species selected from the group of oxide particles bearing anionic charges and dispersed, an anionic water-soluble organic polymer, a nonionic water-soluble organic polymer, an anionic surfactant and a nonionic surfactant, and is adjusted to pH 4 to 13.

Further, in Japanese Kokai Publication 2000-96256, there is disclosed a treatment solution for conditioning a surface before applying chemical conversion treatment of a phosphate coat, which contains particles of one or more species of phosphate selected from phosphate containing one or more species of bivalent and/or trivalent metals and further contains (1) one or more species selected from monosaccharides, polysaccharides and derivatives thereof, or (2) one or more species of orthophosphoric acid, polyphosphoric acid or organic phosphonic acid compounds, or (3) one or more species of water-soluble high polymer compounds which consists of polymer of vinyl acetate, its derivative or copolymer of monomer being copolymerizable with vinyl acetate and vinyl acetate, or (4) polymer or copolymer obtained by polymerizing at least one species selected from specific monomers or α, β unsaturated carboxylic acid monomers, and monomer being copolymerizable with the above monomer in an amount of 50% by weight or less.

However, the treatment solution for conditioning a surface disclosed here has a problem that in an area where an aluminum alloy is in contact with a steel sheet or a galvanized steel sheet, a chemical conversion coat is hard to be formed on the aluminum alloy since a portion of an aluminum alloy becomes an anode and a portion of a steel sheet or a galvanized steel sheet becomes a cathode. Therefore, it is desired to develop a surface conditioner which can inhibit galvanic corrosion on an aluminum alloy in chemical conversion treatment.

And, these treatment solutions for conditioning a surface have a problem that a sufficient chemical conversion coat is not formed on a metal surface when applied to metals such as an aluminum alloy or a high tensile strength steel sheet. Further, these treatment solutions for conditioning a surface also have a problem that since these treatment solutions have a large particle diameter and the stability of particles in a treatment bath is insufficient, particles are apt to precipitate.

SUMMARY OF THE INVENTION

In view of the above-mentioned state of the art, it is an object of the present invention to provide a surface conditioner which can inhibit galvanic corrosion on an aluminum alloy during chemical conversion treatment and can form a sufficient chemical conversion coat when applied to an aluminum alloy and a high tensile strength steel sheet and has the excellent stability of dispersion in a treatment bath.

The present invention pertains to a surface conditioner, containing zinc phosphate particles and having a pH of 3 to 12, wherein the above-mentioned zinc phosphate particles have $D_{50}$ of 3 μm or less and the above-mentioned surface conditioner further contains at least one species selected from the group consisting of (1) carboxylate group-containing copolymers obtained by copolymerizing a monomer composition containing at least one species selected from the group consisting of acrylic acid, maleic acid, maleic anhydride, itaconic acid and itaconic anhydride in an amount less than 50% by weight and at least one species selected from the group consisting of a sulfonic acid monomer, styrene, olefin monomers, amino group-containing monomers and polyoxyalkylene derivatives expressed by the following formula (I);

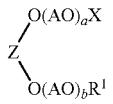

(I)

wherein Z is a residue of a compound having two hydroxyl groups, AOs are oxyalkylene groups having 2 to 18 carbon atoms, X is an unsaturated hydrocarbon group having 2 to 5 carbon atoms, $R^1$ is a hydrocarbon group having 1 to 40 carbon atoms, and a and b are identical to or different from each other and integers of 0 to 1000, and satisfy the relationship of $a+b \geqq 1$ in an amount more than 50% by weight, (2) polyamino acids having a constituent unit expressed by the following formula (II);

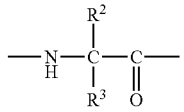

(II)

wherein $R^2$ and $R^3$ are identical to or different from each other and are a straight-chain or branched alkyl group having 1 to 22 carbon atoms, a cycloalkyl group having 6 to 22 carbon atoms or an allyl group having 6 to 22 carbon atoms, and the above $R^2$ and the above $R^3$ may have a substituent including heteroatoms, and (3) phosphate esters expressed by the following formula (III);

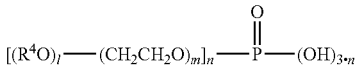

(III)

wherein $R^4$ is an alkyl group or an alkyl phenol group having 8 to 30 carbon atoms, and l is 0 or 1, m is 1 to 20 and n is 1, 2 or 3, or the following formula (IV);

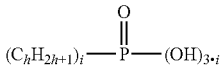

(IV)

wherein h is an integer of 2 to 24 and i is 1 or 2.

The above-mentioned carboxylate group-containing copolymer is preferably obtained by polymerizing a monomer composition containing acrylic acid in an amount less than 50% by weight, and 2-acrylamido-2-methyl propane sulfonic acid and/or allyl sulfonic acid in a total amount more than 50% by weight.

The above-mentioned polyamino acid is preferably sodium polyaspartate.

The above-mentioned phosphate ester is preferably 2-ethylhexyl acid phosphate.

Preferably, the above-mentioned surface conditioner contains a laminar clay mineral.

The above-mentioned laminar clay mineral is preferably a natural hectorite and/or a synthetic hectorite.

The above-mentioned laminar clay mineral is preferably a bentonite surface treated with alkyltrialkoxysilane expressed by the following formula (V);

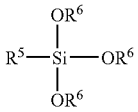

(V)

in the formula $R^5$ is a saturated alkyl group having 1 to 22 carbon atoms, and $R^6$ s are identical to or different from one another and a methyl, ethyl, propyl or butyl group.

The present invention also pertains to a method of a surface conditioning, comprising the step of bringing the above-mentioned surface conditioner into contact with a metal surface.

EXPLANATION OF THE NUMERICAL SYMBOLS

Figure 1:
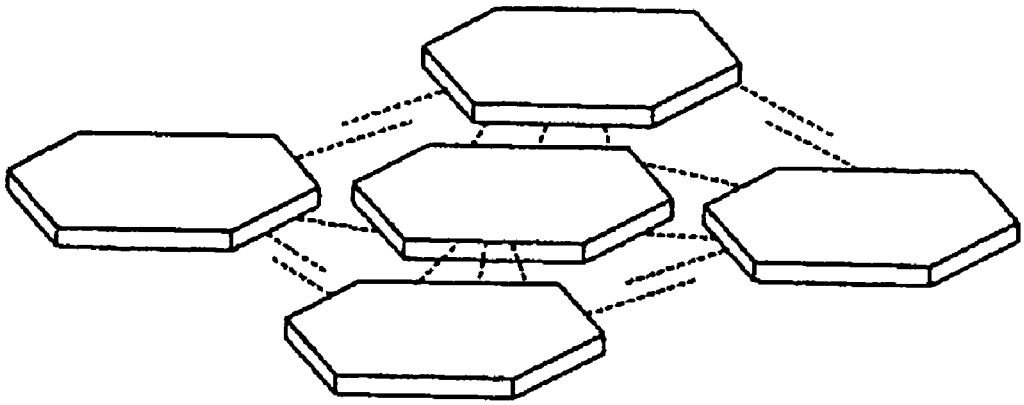
FIG. 1 is a schematic view of alkyltrialkoxysilane modified bentonite having a patchwork structure.

1 galvanic corrosion area
2 galvanized steel sheet
3 aluminum steel sheet
4 general area
5 clip

DETAILED DESCRIPTION OF THE INVENTION

Hereinafter, the present invention will be described in detail.

The surface conditioner of the present invention allows fine particles of zinc phosphate to adhere to a metal surface through their uses in a surface conditioning which is pretreatment of chemical conversion treatment of a phosphate coat and promotes formation of a zinc phosphate coat using the above fine particles as the crystal nuclei in a step of chemical conversion treatment of zinc phosphate to form a good zinc phosphate coat. When chemical conversion treatment is performed after conducting a surface conditioning of metal material using this function of pretreatment, it is possible to precipitate fine phosphate crystals in a relatively short time of chemical conversion treatment and to cover a whole metal surface with the precipitated crystals.

The surface conditioner of the present invention contains zinc phosphate particles having $D_{50}$ of 3 μm or less and at least one species selected from the group consisting of specific carboxylate group-containing copolymers, polyamino acids and phosphate esters and has a pH of 3 to 12. The surface conditioner of the present invention, compared with the publicly known surface conditioner, can inhibit galvanic corrosion on an aluminum alloy during chemical conversion treatment and can form a sufficient chemical conversion coat when applied to an aluminum alloy and a high tensile strength steel sheet and has the excellent stability of dispersion in a treatment bath.

There may be cases where an iron-based or zinc-based substrate and an aluminum-based substrate are used as a metal material to which a surface conditioner is applied and these substrates have an area where the above iron-based or zinc-based substrate is in contact with the above aluminum-based substrate. When the chemical conversion treatment is applied to the substrates in this case, since the portion of the aluminum-based substrate becomes an anode and the portion of the iron-based or zinc-based substrate becomes a cathode at this contact area in applying the chemical conversion treatment, and therefore there is a problem that a chemical conversion coat becomes hard to be formed on the portion of the aluminum-based substrate in the contact area. It is assumed that the surface conditioner of the present invention accelerates a chemical conversion treatment rate because of increasing in an amount of the surface conditioner adsorbed on an article to be treated, and that as a result of this, the surface conditioner of the present invention can inhibit galvanic corrosion on the portion of the aluminum-based substrate in a contact area between an iron-based or zinc-based substrate and an aluminum-based substrate compared with the case where a conventional surface conditioner is used. Therefore, when a surface conditioning is applied to a substrate having an area where the iron-based or zinc-based substrate and the aluminum-based substrate are in contact with each other using the surface conditioner of the present invention and then chemical conversion treatment is conducted, a good chemical conversion coat can be formed on the portion of the aluminum-based substrate in the contact area.

When a publicly known surface conditioner, containing bivalent or trivalent phosphate particles, is applied to the aluminum-based substrate or the high tensile strength steel sheet, a chemical conversion coat of a sufficient coat amount is not formed in chemical conversion treatment and therefore there is a problem that adequate corrosion resistance cannot be provided for these substrates. On the other hand, when the surface conditioner of the present invention is used, a chemical conversion coat of a sufficient coat amount can be formed in chemical conversion treatment even for the aluminum-based substrate and the high tensile strength steel sheet and therefore adequate corrosion resistance can be provided for these substrates.

And, since the publicly known surface conditioners, containing bivalent or trivalent phosphate particles, have a large particle diameter of phosphate particles, the stability of particles in a treatment bath of a surface conditioning is insufficient. Therefore, there is a problem that phosphate particles are apt to precipitate. On the contrary, the surface conditioner of the present invention is superior in the stability of particles in a treatment bath because of containing zinc phosphate particles having $D_{50}$ of 3 μm or less and can inhibit the precipitation of the zinc phosphate particles in a treatment bath.

The surface conditioner of the present invention contains at least one species selected from the group consisting of specific carboxylate group-containing copolymers, polyamino acids and phosphate esters. These components act as a dispersant and simultaneously containing these components allows chemical conversion treatment in applying chemical conversion treatment to be accelerated. Therefore, it is possible to form a dense chemical conversion coat in the chemical conversion treatment and to improve the corrosion resistance. Though the reason why by using the surface conditioner containing these components, the chemical conversion treatment can be accelerated and the dense chemical conversion coat can be formed is not defined, it is assumed that ends of these components are easy to be adsorbed on a substrate.

As a component contained in the surface conditioner of the present invention, there can be given a carboxylate group-containing copolymer obtained by copolymerizing a monomer composition containing at least one species selected from the group consisting of acrylic acid, maleic acid, maleic anhydride, itaconic acid and itaconic anhydride in an amount less than 50% by weight and at least one species selected from the group consisting of a sulfonic acid monomer, styrene, olefin monomers, amino group-containing monomers and polyoxyalkylene derivatives expressed by the above formula (I) in an amount more than 50% by weight. By using the carboxylate group-containing copolymer obtained by blending the specific monomers like the above in specific amounts, the effects of the present invention like the above can be attained.

The above-mentioned sulfonic acid monomer is not particularly limited as long as it is a monomer having a sulfonate acid group and includes sulfonic acid-containing (meth)acrylamido such as 2-(meth)acrylamido-2-methyl propane sulfonic acid, 3-(meth)acrylamidopropane-1-sulfonic acid, 2-(meth)acrylamidoethyl-1-sulfonic acid, 3-(meth)acrylamido-2-hydroxypropane sulfonic acid and p-(meth)acrylamidomethylbenzenesulfonic acid; aromatic hydrocarbon vinylsulfonic acid such as styrenesulfonic acid, styrenedisulfonic acid, α-methylstyrenesulfonic acid and vinylphenylmethanesulfonic acid; sulfonate-containing (meth)acrylate such as 3-(meth)acryloyloxypropane-1-sulfonic acid, 4-(meth)acryloyloxybutane-2-sulfonate, 2-(meth)acryloyloxyethyl-1-sulfonic acid and 3-(meth)acryloyloxy-2-hydroxypropane sulfonic acid; aliphatic hydrocarbon vinylsulfonic acid such as vinylsulfonic acid and (meth)allylsulfonic acid; and salts thereof.

As the above-mentioned salt, there can be given alkali metal salts such as sodium, potassium and the like, alkaline earth metal salts such as calcium, magnesium and the like, ammonium salts, and ammonium salts having an organic substituent such as methylamine, ethylamine, dimethylamine, diethylamine, triethylamine and the like. These sulfonic acid monomers may be used alone or in combination of two or more species.

The above-mentioned olefin monomer is not particularly limited and for example, straight-chain or branched α-olefins such as ethylene, propylene, 1-butene, 2-butene, isobutene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene can be given. These monomers may be used alone or in combination of two or more species.

The above-mentioned amino group-containing monomer is not particularly limited as long as it is a polymerizable monomer having at least one amino group selected from a primary amino group, a secondary amino group and a tertiary amino group in a molecule and publicly known primary amino group-containing monomers, secondary amino group-containing monomers and tertiary amino group-containing monomers can be given.

The above-mentioned primary amino group-containing monomer is not particularly limited and for example, p-aminostyrene, aminomethyl (meth)acrylate, aminoethyl (meth) acrylate, aminopropyl (meth)acrylate, aminobutyl (meth) acrylate, etc. can be given.

The above-mentioned secondary amino group-containing monomer is not particularly limited and for example, N-monosubstituted (meth)acrylamides such as N-methyl (meth)acrylamide, N-ethyl(meth)acrylamide, N-methylolacrylamide and N-(4-anilinophenyl)methacrylamide can be given.

The above-mentioned tertiary amino group-containing monomer is not particularly limited and for example, N,N-disubstituted aminoalkyl (meth)acrylates, N,N-disubstituted aminoalkyl (meth)acrylamides, N,N-disubstituted aminoaromatic vinyl compounds and polymerizable monomers having a pyridyl group can be given.

As the above-mentioned N,N-disubstituted aminoalkyl (meth)acrylate, there can be given, for example, N,N-dimethylaminomethyl (meth)acrylate, N,N-dimethylaminoethyl (meth)acrylate, N,N-dimethylaminopropyl (meth)acrylate, N,N-dimethylaminobutyl (meth)acrylate, N,N-diethylaminoethyl (meth)acrylate, N,N-diethylaminopropyl (meth) acrylate, N,N-diethylaminobutyl (meth)acrylate, N-methyl-N-ethylaminoethyl (meth)acrylate, N,N-dipropylaminoethyl (meth)acrylate, N,N-dibutylaminoethyl (meth)acrylate, N,N-dibutylaminopropyl (meth)acrylate, N,N-dibutylaminobutyl (meth)acrylate, N,N-dihexylaminoethyl (meth)acrylate, and N,N-dioctylaminoethyl (meth)acrylate.

As the above-mentioned N,N-disubstituted aminoalkyl (meth)acrylamide, there can be given, for example, N,N-dimethylaminomethyl(meth)acrylamide, N,N-dimethylaminoethyl(meth)acrylamide, N,N-dimethylaminopropyl(meth) acrylamide, N,N-dimethylaminobutyl(meth)acrylamide, N,N-diethylaminoethyl(meth)acrylamide, N,N-diethylaminopropyl(meth)acrylamide, N,N-diethylaminobutyl(meth) acrylamide, N-methyl-N-ethylaminoethyl(meth)acrylamide, N,N-dipropylaminoethyl(meth)acrylamide, N,N-dibutylaminoethyl(meth)acrylamide, N,N-dibutylaminopropyl (meth)acrylamide, N,N-dibutylaminobutyl(meth)acrylamide, N,N-dihexylaminoethyl(meth)acrylamide, N,N-dihexylaminopropyl(meth)acrylamide, and N,N-dioctylaminopropyl(meth)acrylamide.

As the above-mentioned N,N-disubstituted aminoaromatic vinyl compound, there can be given, for example, N,N-dimethylaminoethylstyrene, N,N-diethylaminoethylstyrene, N,N-dipropylaminoethylstyrene, and N,N-dioctylaminoethylstyrene.

As the polymerizable monomer having a pyridyl group, there can be given, for example, 2-vinylpyridine, 4-vinylpyridine, 5-methyl-2-vinylpyridine and 5-ethyl-2-vinylpyridine. These amino group-containing monomers may be used alone or in combination of two or more species.

In a polyoxyalkylene derivative expressed by the above formula (I), as the compound having two hydroxyl groups, containing Z as a residue, there can be given dihydric phenols such as catechol, resorcin and hydroquinone, and dihydric alcohols such as ethylene glycol, propylene glycol, butylene glycol, dodecylene glycol, octadecylene glycol, neopentyl glycol and styrene glycol.

In the above formula (I), as the above-mentioned oxyalkylene group, expressed by AO, having 2 to 18 carbon atoms, there can be given an oxyethylene group, an oxypropylene group, an oxybutylene group, an oxytetramethylene group, an oxystyrene group, an oxydodecylene group, an oxytetradecylene group, an oxyhexadecylene group and an oxyoctadecylene group. Among others, oxyalkylene groups having 2 to 4 carbon atoms are preferred.

In the above formula (I), the above-mentioned a and the above-mentioned b are identical to or different from each other and integers of 0 to 1000. And they satisfy the relationship of $a+b \geqq 1$ and particularly the value of a+b is preferably 1 to 300.

In the above formula (I), number of carbon atoms of the above X has a bearing on a polymerizing property and when it is too large, the polymerizing property becomes poor, and therefore X has 2 to 5 carbon atoms. As the above-mentioned unsaturated hydrocarbon group, expressed by X, having 2 to 5 carbon atoms, there can be given, for example, a vinyl group, an allyl group, a methallyl group, a 3-butenyl group, a 4-pentenyl group and a 3-methyl-3-butenyl group.

In the above formula (I), as the above-mentioned hydrocarbon group, expressed by $R^1$, having 1 to 40 carbon atoms, there can be given, for example, a methyl group, an ethyl group, a propyl group, an isopropyl group, a butyl group, a isobutyl group, a tert-butyl group, an amyl group, an isoamyl group, a hexyl group, a heptyl group, a 2-ethylhexyl group, an octyl group, a nonyl group, a decyl group, an undecyl group, a dodecyl group, an isotridecyl group, a tetradecyl group, a hexadecyl group, anisohexadecyl group, anoctadecyl group, an isooctadecyl group, an oleyl group, an octyldodecyl group, a docosyl group, a decyltetradecyl group, a benzyl group, a cresyl group, a butylphenyl group, a dibutylphenyl group, an octylphenyl group, a nonylphenyl group, a dodecylphenyl group, a dioctylphenyl group, a dinonylphenyl group, a naphthyl group and a styrenated phenyl group.

A monomer composition for producing the above carboxylate group-containing copolymer may contain another monomer other than the monomers described above to the extent of not inhibiting the effects of the present invention.

As the above-mentioned another monomer, there can be given, for example, methyl acrylate, ethyl acrylate, propyl acrylate, butyl acrylate, pentyl acrylate, methyl methacrylate, ethyl methacrylate, propyl methacrylate, butyl methacrylate, pentyl methacrylate, hydroxymethyl acrylate, hydroxyethyl acrylate, hydroxypropyl acrylate, hydroxybutyl acrylate, hydroxypentyl acrylate, hydroxymethyl methacrylate, hydroxyethyl methacrylate, hydroxypropyl methacrylate, hydroxybutyl methacrylate, hydroxypentyl methacrylate and vinyl acetate. These other monomers may be used alone or in combination of two or more species.

The above carboxylate group-containing copolymer is preferably a polymer obtained by copolymerizing a monomer composition containing acrylic acid, and 2-acrylamido-2-methyl propane sulfonic acid, allyl sulfonic acid, ethylene, diisobutylene, tertiary-amino group-containing monomer, styrene, styrenesulfonic acid or acrylamide. The above 2-acrylamido-2-methyl propane sulfonic acid, allyl sulfonic acid, ethylene, diisobutylene, tertiary-amino group-containing monomer, styrene, styrenesulfonic acid and acrylamide may be used alone or in combination of two or more species. Among others, the carboxylate group-containing copolymer is preferably obtained by polymerizing a monomer composition containing acrylic acid in an amount less than 50% by weight, and 2-acrylamido-2-methyl propane sulfonic acid and/or allyl sulfonic acid in a total amount more than 50% by weight.

And, when the above carboxylate group-containing copolymer is obtained by copolymerizing a monomer composition containing a polyoxyalkylene derivative expressed by the above formula (I), a copolymer obtained by copolymerizing a monomer composition containing maleic anhydride and a polyoxyalkylene derivative expressed by the above formula (I) is preferred.

When the above carboxylate group-containing copolymer is obtained by copolymerizing a monomer composition containing maleic anhydride and a polyoxyalkylene derivative expressed by the above formula (I), a portion of an unsaturated bond expressed by X in the above formula (I) and a portion of maleic anhydride, maleic acid or maleate preferably have a molar ratio of 3:7 to 7:3, more preferably 4:6 to 6:4, and particularly preferably 5:5.

Further, when the above carboxylate group-containing copolymer is obtained by copolymerizing the monomer composition containing a polyoxyalkylene derivative expressed by the above formula (I), a copolymer obtained by copolymerizing a monomer composition containing acrylic acid and maleic acid, and a compound of the above formula (I) in which AOs are oxypropylene groups, and a copolymer obtained by copolymerizing a monomer composition containing maleic acid and a compound of the above formula (I) in which AOs are an oxybutylene group and an oxypropylene group are more preferred. When the carboxylate group-containing copolymer, which has been given as a preferred example, is used, a better chemical conversion coat can be formed on the portion of the aluminum-based substrate in the contact area between an iron-based or zinc-based substrate and an aluminum-based substrate. And, a chemical conversion coat of a more sufficient coat amount can be formed for an aluminum-based substrate and a high tensile strength steel sheet.

The above carboxylate group-containing copolymer can be readily obtained by using a conventional technique publicly known such as copolymerizing a monomer composition containing acrylic acid, maleic acid, maleic anhydride, itaconic acid and itaconic anhydride described above, and a sulfonic acid monomer, styrene, an olefin monomer, an amino group-containing monomer and a polyoxyalkylene derivative expressed by the above formula (I) in the presence of a catalyst such as peroxides.

And, the above carboxylate group-containing copolymer may be a hydrolysate of a copolymer obtained thus. This hydrolysate refers to a maleic acid unit or an itaconic acid unit, which is formed through the hydrolysis of a maleic anhydride unit or an itaconic anhydride unit obtained by copolymerization, in the case where maleic anhydride or itaconic anhydride is used. Further, the above carboxylate group-containing copolymer may be salt of a copolymer obtained thus. This salt is one which an acrylic acid unit, an maleic acid unit or an itaconic acid unit forms, and it can include alkali metal salts and alkaline earth metal salts such as lithium salt, sodium salt, potassium salt, magnesium salt, calcium salt and the like and in addition ammonium salt and organic amine salt.

As the above-mentioned organic amine salt, there can be given aliphatic or aromatic monoamine salts such as methylamine salts, ethylamine salts, propylamine salts, butylamine salts, amylamine salts, hexylamine salts, octylamine salts, 2-ethylhexylamine salts, decylamine salts, dodecylamine salts, isotridecylamine salts, tetradecylamine salts, hexadecylamine salts, isohexadecylamine salts, octadecylamine salts, isooctadecylamine salts, octyldodecylamine salts, docosylamine salts, decyltetradecylamine salts, oleylamine salt, linoleamine salts, dimethylamine salts, trimethylamine salts andaniline salts, polyamine salts such as ethylenediamine salts, tetramethylenediamine salts, dodecyl-propylenediamine salts, tetradecyl-propylenediamine salts, hexadecyl-propylenediamine salts, octadecyl-propylenediamine salts, oleyl-propylenediamine salt, diethylenetriamine salts, triethylenetetramine salts, tetraethylenepentamine salts and pentaethylenehexamine salts, alkanolamine salts such as monoethanolamine salts, diethanolamine salts, triethanolamine salts, monoisopropanolamine salts, diisopropanolamine salts, triisopropanolamine salts, salts of alkyleneoxide adduct thereof and salts of alkyleneoxide adduct of primary amine or secondary amine, and amino acid salts such as lysine salts and arginine salts. Among others, alkali metal salts, ammonium salts, and alkanolamine salts are preferred.

As a commercially available product of the above carboxylate group-containing copolymer, there can be given, for example, ARON A6020 (produced by TOAGOSEI CO., LTD.), A-221M (produced by JAPAN POLYETHYLENE CORPORATION), POLYSTAR OM, POLYSTAR OMA (produced by NOF CORPORATION), EFKA-4550 (produced by EFKA Additives B.V.), PX1ELK-100 (produced by NIPPON SHOKUBAI CO., LTD.), MALIALIM AKM0531 (produced by NOF CORPORATION), SMA 1440H (produced by Sartomer Company, Inc.), JONCRYL60 (produced by JOHNSON POLYMER CORPORATION).

In the above carboxylate group-containing copolymer, the content (total content of these compounds) of at least one species selected from the group consisting of acrylic acid, maleic acid, maleic anhydride, itaconic acid and itaconic anhydride is less than 50% by weight with respect to 100% by weight of the monomer composition. When the content is 50% by weight or more, a good chemical conversion coat may not be formed on the portion of the aluminum-based substrate in the contact area between the iron-based or zinc-based substrate and the aluminum-based substrate. And, a sufficient amount of chemical conversion coat may not be formed on the aluminum-based substrate or the high tensile strength steel sheet. A lower limit of the above content is more preferably 20% by weight, furthermore preferably 25% by weight. An upper limit of the above content is more preferably 45% by weight, furthermore preferably 40% by weight.

In the above carboxylate group-containing copolymer, the content (total content of these compounds) of at least one species selected from the group consisting of a sulfonic acid monomer, styrene, olefin monomers, amino group-containing monomers and polyoxyalkylene derivatives expressed by the above formula (I) is more than 50% by weight with respect to 100% by weight of the monomer composition. When the content is 50% by weight or less, a good chemical conversion coat may not be formed on the portion of the aluminum-based substrate in the contact area between the iron-based or zinc-based substrate and the aluminum-based substrate. And, a sufficient amount of chemical conversion coat may not be formed on the aluminum-based substrate or the high tensile strength steel sheet. A lower limit of the above content is more preferably 55% by weight, furthermore preferably 60% by weight. An upper limit of the above content is more preferably 80% by weight, furthermore preferably 75% by weight.

An acid value of the above carboxylate group-containing copolymer is preferably within a range of 10 (lower limit) to 1000 (upper limit). When it is less than 10 or more than 1000, the dispersibility of zinc phosphate particles may be deteriorated. More preferably, the above lower limit is 30 and the above upper limit is 800.

A number average molecular weight of the above carboxylate group-containing copolymer is preferably within a range of 100 (lower limit) to 30000 (upper limit). When it is less than 100, a sufficient effect of dispersion may not be attained. When it is more than 30000, a sufficient effect of dispersion may not be attained and in addition flocculation of particles may occur. More preferably, the above lower limit is 1000 and the above upper limit is 20000.

As a component contained in the surface conditioner of the present invention, there can be given polyamino acid having a constituent unit expressed by the above formula (II). By using the above-mentioned polyamino acid, the effects of the present invention like the above can be attained.

In the above formula (II), $R^2$ and $R^3$ are identical to or different from each other and are a straight-chain or branched alkyl group having 1 (lower limit) to 22 (upper limit) carbon atoms, a cycloalkyl group having 6 (lower limit) to 22 (upper limit) carbon atoms or an aryl group having 6 (lower limit) to 22 (upper limit) carbon atoms. The above $R^2$ and the above $R^3$ may have a substituent including heteroatoms. As the above substituent including heteroatoms, there can be given a hydroxyl group, a mercapto group, a dithioether group, an amino group, a guanidine group, an ester group, an ether group and an amido group.

The above-mentioned polyamino acid is not particularly limited as long as it satisfies $R^2$ and $R^3$ in the above formula (II), but the above $R^2$ and the above $R^3$ are preferably a straight-chain or branched alkyl groups having 1 (lower limit) to 8 (upper limit) carbon atoms.

As the above polyamino acid, there can be given polymers of neutral amino acid such as polyglycine, polyalanine, poly (N-methylglycine), polyproline, etc.; polymers of acidic amino acid such as polyglutamic acid, polyaspartic acid, etc.; polymers of acidic amino acid ester such as poly(γ-methylglutamic acid), poly(β-methylaspartic acid), etc.; polymers of basic amino acid such as poly(ε-lysine), poly(σ-ornithine), etc.; polymers of acylated basic amino acid such as poly(δ-N-acetyllysine), poly(σ-N-carbobenzoxyornithine), etc.; polymers of amino acid having a hydroxyl group or a mercapto group such as polyserine, polycysteine, polyarginine, polyhistidine and the like and acetyl or isopropylidene derivatives thereof; salts thereof.

As the above salt of polyamino acid, there can be given salts of alkali metals such as sodium, potassium, etc., organic amines such as diethanolamine, triethanolamine, etc. and basic amino acid such as arginine, lysine, etc. And, a side chain of the above polyamino acid may be modified by amidation or esterification.

Among the above polyamino acid, sodium polyaspartate is more preferably. Thereby, a better chemical conversion coat can be formed on the portion of the aluminum-based substrate in the contact area between the iron-based or zinc-based substrate and the aluminum-based substrate. And, a chemical conversion coat of a more sufficient coat amount can be formed for the aluminum-based substrate and the high tensile strength steel sheet.

As a commercially available product of the above polyamino acid, there can be given, for example, AQUADEW SPA-30 (produced by Ajinomoto-Fine-Techno Co., Inc.) or the like. The above polyamino acids may be used alone or in combination of two or more species.

A number average molecular weight of the above polyamino acid is preferably within a range of 500 (lower limit) to 30000 (upper limit). When it is less than 500 or more than 30000, there is a possibility that zinc phosphate particles are not adequately dispersed. More preferably, the above lower limit is 800 and the above upper limit is 20000.

As a component contained in the surface conditioner of the present invention, there can be given phosphate ester expressed by the above formula (III) or the above formula (IV) By using the above-mentioned phosphate ester, the effects of the present invention like the above can be attained.

In the phosphate ester expressed by the above formula (III), the above $R^4$ is an alkyl group or an alkyl phenol group having 8 (lower limit) to 30 (upper limit) carbon atoms. The above l is 0 or 1. The above m is 1 (lower limit) to 20 (upper limit). The above n is 1, 2 or 3. The alkyl group or the alkyl phenol group of the above $R^4$ may be straight-chain or branched.

Among the phosphate esters expressed by the above formula (III), phosphate monoester and phosphate diester, in which the above $R^4$ is an isotridecyl group, the above l is 1, the above m is 3 to 15 and the above n is 1 or 2 in the above formula (III), are preferred. When these phosphate esters are used, a better chemical conversion coat can be formed on the portion of the aluminum-based substrate in the contact area between the iron-based or zinc-based substrate and the aluminum-based substrate. And, a chemical conversion coat of amore sufficient coat amount can be formed for the aluminum-based substrate and the high tensile strength steel sheet.

In the phosphate ester expressed by the above formula (IV), the above h is an integer of 2 (lower limit) to 24 (upper limit) The above i is 1 or 2. A saturated alkyl group expressed by $C_hH_{2h+1}$ in the above formula (IV) may be straight-chain or branched.

Among the phosphate esters expressed by the above formula (IV), 2-ethylhexyl acid phosphate, in which the above h is 8 and the above i is 1 or 2, is preferred. Thereby, a better chemical conversion coat can be formed on the portion of the aluminum-based substrate in the contact area between the iron-based or zinc-based substrate and the aluminum-based substrate. And, a chemical conversion coat of a more sufficient coat amount can be formed for the aluminum-based substrate and the high tensile strength steel sheet.

As a commercially available product of the above phosphate esters expressed by the formula (III) and the formula (IV), there can be given, for example, PHOSPHANOL RS-410, PHOSPHANOL RS-610 (produced by TOHO Chemical Industry Co., LTD), EXQ-2300 (produced by Kusumoto Chemicals, Ltd.) and JP-508 (produced by Johoku Chemical Co., Ltd.).

In the above-mentioned surface conditioner, the content (total content of these compounds) of at least one species selected from the group consisting of the above carboxylate group-containing copolymer, polyamino acid and phosphate ester is preferably within a range of 1 ppm (lower limit) to 1000 ppm (upper limit). When the content is less than 1 ppm, a disperse power is insufficient and a particle diameter of zinc phosphate particles may become large and simultaneously the stability of a solution may be deteriorated and particles may be apt to precipitate. When it is more than 1000 ppm, the adsorption on a metal surface occurs, and therefore this may have the effect on a subsequential chemical conversion step. A lower limit of the above content is more preferably 10 ppm and an upper limit of the above content is more preferably 500 ppm.

Further, in the above surface conditioner, a dispersant may be further blended in addition to the components described above to the extent of not inhibiting the effects of the present invention. The above-mentioned dispersant is not particularly limited and a polymer dispersant, a surfactant and a coupling agent, publicly known, can be given.

The surface conditioner of the present invention contains zinc phosphate particles having $D_{50}$ (diameter at 50% cumulative volume) of 3 μm or less. Since more crystal nuclei can be provided before applying chemical conversion treatment of phosphate by using the zinc phosphate having $D_{50\ of}$ 3 μm or less, fine phosphate crystals can be precipitated in a short time of chemical conversion treatment. In addition, the above $D_{50}$ is an average dispersion diameter and an average particle diameter herein.

$D_{50}$ of the above-mentioned zinc phosphate particles is preferably within a range of 0.01 μm (lower limit) to 3 μm (upper limit). When the $D_{50}$ is less than 0.01 μm, particles may be flocculated due to a phenomenon of excessive dispersion. When it is more than 3 μm, the ratio of fine zinc phosphate particles may become small and it is improper. More preferably, the above lower limit is 0.05 μm and the above upper limit is 1 μm.

The above-mentioned surface conditioner preferably contains zinc phosphate particles having $D_{90}$ (diameter at 90% cumulative volume) of 4 μm or less. In this case, since the above zinc phosphate particles have $D_{50\ of}$ 3 μm or less and in addition have $D_{90}$ of 4 μm or less, a portion of the zinc phosphate particles which coarse particles constitute is relatively small. As described above, fine phosphate crystals can be precipitated in a short time of chemical conversion treatment by using the zinc phosphate having an average particle diameter ($D_{50}$) of 3 μm or less, but when means of a mill is employed in order to disperse the particles so as to have $D_{50\ of}$ 3 μm or less, if the particles are excessively milled, an increased specific surface area causes shortages of the components to act as a dispersant and overdispersed particles are flocculated to form coarse particles by contraries, resulting in the occurrence of a phenomenon of excessive dispersion impairing the stability of dispersion. Further, the formulation and the dispersion conditions of the surface conditioner generate the variation of dispersibility and coarse and fine particles, and cause the flocculation of particles, the increase in viscosity of a solution due to a close-packed structure resulting from coarse and fine particles, and the mutual flocculation of fine particles. But, when the above $D_{90}$ (diameter at 90% cumulative volume) of zinc phosphate is 4 μm or less, the occurrence of such disadvantages can be further protected.

$D_{90}$ of the above zinc phosphate particles is preferably within a range of 0.01 μm (lower limit) to 4 μm (upper limit). When the $D_{90}$ is less than 0.01 μm, particles may be flocculated due to a phenomenon of excessive dispersion. When it is more than 4 μm, the ratio of fine zinc phosphate particles may become small and it is thus improper. More preferably, the above lower limit is 0.05 μm and the above upper limit is 2 μm.

The above $D_{50}$ (diameter at 50% cumulative volume) and $D_{90}$ (diameter at 90% cumulative volume) are particle diameters at points, respectively, which a cumulative curve reaches 50% and 90% when a cumulative curve is determined assuming that the total volume of all particles is 100% based on a particle size distribution in a dispersion. The above $D_{50}$ and $D_{90}$ can be automatically measured by using a particle size measuring apparatus such as a laser Doppler type particle size analyzer (Microtrac UPA 150 manufactured by NIKKISO CO., LTD.).

The above zinc phosphate particles are not particularly limited as long as its $D_{50}$ is 3 μm or less. And, they may be a mixture of particles satisfying the condition that $D_{50}$ *is* 3 μm or less.

The above surface conditioner preferably has a zinc phosphate particles content of 50 ppm (lower limit) to 20000 ppm (upper limit). When the content is less than 50 ppm, phosphate to become crystal nuclei may be insufficient and a sufficient effect of a surface conditioning may not be attained. Since even when the content is more than 20000 ppm, an effect exceeding the desired effect is not attained, it is uneconomical. More preferably, the above lower limit is 150 ppm and the above upper limit is 10000 ppm.

The above surface conditioner is preferably one containing laminar clay minerals in addition to at least one species selected from the group consisting of the above carboxylate group-containing copolymer, polyamino acid and phosphate ester and zinc phosphate particles. In this case, this conditioner prevents not only the precipitation of zinc phosphate particles in the surface conditioner solution but also the precipitation of zinc phosphate particles in the concentrated surface conditioner solution (that is, the concentrated solution which is not yet subjected to adjustment to a surface conditioner solution by dilution), and therefore it can retain the long-range stability of dispersion of the concentrated solution. By adding the laminar clay mineral, an excellent thickening effect can be exerted and repulsion of charged particles can also be exerted by this addition. Accordingly, although the reason why the precipitation of the concentrated surface conditioner solution can be prevented is not clear, it is estimated that an extremely excellent effect of anti-settling of the zinc phosphate particles is exerted in virtue of this thickening effect in synergy with the repulsion of charged particles, and as a result of this, even in the concentrated solution, the precipitation of zinc phosphate particles can be more prevented and the long-range stability of dispersion can be retained.

And, the above-mentioned laminar clay mineral has electric repulsion per se. Thus, when the above laminar clay mineral adheres to circumferences of zinc phosphate particles, zinc phosphate particles in the concentrated surface conditioner solution can be stabilized by electric repulsion. Therefore, in preparation of the concentrated surface conditioner solution (liquid concentrate), it is possible to attain finer zinc phosphate particles in dispersing the ingredients such as zinc phosphate particles in the solution and also to improve dispersion efficiency more.

The above laminar clay mineral is a silicate mineral or the like having a laminar structure and a substance formed through the lamination of many sheets (tetrahedral sheet constituted of silicic acid, octahedral sheet constructed by further containing Al, Mg or the like, etc.). By containing the above laminar clay mineral, it is possible to provide excellent stability of dispersion for the concentrated surface conditioner solution and also to improve dispersion efficiency.

The above laminar clay mineral is not particularly limited and can include a smectite group such as montmorillonite, beiderite, saponite, hectorite and the like; a kaolinite group such as kaolinite, hallosite and the like; a vermiculite group such as dioctahedral vermiculite, trioctahedral vermiculite and the like; micas such as taeniolite, tetrasilicic mica, muscovite, illite, sericite, phlogopite, biotite and the like; hydrotalcite; pyrophyllolite; and laminar polysilicates such as kanemite, makatite, ilerite, magadiite, kenyaite and the like. These laminar clay minerals may be natural minerals or may be synthetic minerals by hydrothermal synthesis, a fusion method or a solid phase method.

And, intercalation compounds of the above laminar clay mineral (pillared crystal, etc.), a substance obtained by ion-exchanging the above laminar clay mineral and a substance obtained by applying surface treatment (treatment with a silane coupling agent, treatment by forming a composite with an organic binder) to the above laminar clay mineral can also be used. These laminar clay minerals may be used alone or in combination of two or more species.

Each of the above laminar clay mineral preferably has an average diameter (an average of maximum lengths) of 5 μm or less and more preferably an average diameter of 1 μm or less. When the average diameter is more than 5 μm, the stability of dispersion may be deteriorated. And, an average aspect ratio (=an average of maximum length/minimum length) of the above laminar clay mineral is preferably 10 or more, more preferably 20 or more and furthermore preferably 40 or more. When it is less than 10, the stability of dispersion may be deteriorated.

The above laminar clay minerals are preferably natural hectorite and/or synthetic hectorite. These hectorites can provide the more excellent stability of dispersion for the concentrated surface conditioner solution and can improve the dispersion efficiency more.

The above-mentioned natural hectorite is a trioctahedral type clay mineral included in a montmorillonite group expressed by the following formula (VI);

$$[Si_8(Mg_{5.34}Li_{0.66})O_{20}(OH)_4M^+_{0.66}\cdot nH_2O] \quad \text{(VI)}$$

As a commercially available product of the above natural hectorite, there can be given, for example, BENTON EW, BENTON AD (produced by ELEMENTIS PLC), etc.

The above-mentioned synthetic hectorite is a substance which is analogous to hectorite belonging to a trioctahedral mineral of an infinite layer expansion type having a crystal trilaminar structure and an expansive lattice and expressed by the following formula (VII);

$$[Si_8(Mg_aLi_b)O_{20}(OH)_cF_{4-c}]^{X-}M^{X+} \quad \text{(VII)}$$

wherein a, b and c satisfy the relationship of $0<a\leqq 6$, $0<b\leqq 6$, $4<a+b<8$, $0\leqq c<4$ and $x=12-2a-b$, and M is almost sodium. The synthetic hectorite comprises magnesium, silicon, sodium, as the main ingredients, and a trace of lithium and fluorine.

The above synthetic hectorite has a trilaminar structure and each layer of a crystal structure in the laminar structure consists of two-dimensional platelets of about 1 nm in thickness. A lithium atom having a low valence isomorphically substitutes for a part of magnesium atoms existing in a middle layer of this platelet unit and therefore the platelet unit is negatively charged. In a dry condition, this negative charge balances with a displaceable cation present at the outside of a lattice structure in a plate plane and these particles are combined with one another by a Van der Waals force in a solid phase to form a bundle of plates.

When such synthetic hectorite is dispersed in a water phase, a displaceable cation is hydrated and particles cause swelling, and stable sol can be attained by dispersing the resulting particles using a usual dispersing machine such as a high-speed dissolver. In such a state of being dispersed in a water phase, the platelets bear negative charges on its surface, repel one another by virtue of their electrostatic and become stable sol which has been fractionized up to a primary particle of a platelet form. But, when a concentration of particles or a concentration of ions is increased, repulsion by virtue of negative charge on the surface is decreased and this allows an end portion of the platelet positively charged to be electrically oriented to a plate of another platelet negatively charged and forms the so-called card house structure, resulting in an increase in viscosity.

It is estimated that when the above synthetic hectorite is used, an excellent thickening property can be thus exerted and therefore it is possible to prevent zinc phosphate particles more from precipitating not only in the surface conditioner but also in the concentrated solution and as a result of this, it is possible to retain the long-range stability of dispersion of the concentrated solution more. And, it is estimated that since the zinc phosphate particles in the concentrated solution of the surface conditioner can be more stabilized, it is possible to attain finer zinc phosphate particles in dispersing the ingredients such as zinc phosphate particles and also to improve the dispersion efficiency more.

As a commercially available product of the above synthetic hectorite, there can be given, for example, B, S, RD, RDS, XLG and XLS types of LAPONITE (trade name) series produced by Laporte Industries Ltd. These are white powder and readily form sol (S, RDS and XLS types of LAPONITE series) or gel (B, RD and XLG types of LAPONITE series) when dissolved in water. In addition, there can also be given LUCENTITE SWN produced by CO-OP CHEMICAL Co., Ltd. These natural hectorite and synthetic hectorite may be used alone or in combination of two or more species.

The above laminar clay mineral contains is preferably obtained by surface treating bentonite (montmorillonite) with alkyltrialkoxysilane expressed by the following formula (V);

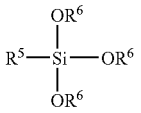

(V)

wherein $R^5$ is a saturated alkyl group having 1 to 22 carbon atoms, and $R^6$s are identical to or different from one another, and a methyl, ethyl, propyl or butyl group. In the above formula (V), the above $R^5$ may be either straight-chain or branched.

Surface treatment of the above-mentioned bentonite (montmorillonite) with alkyltrialkoxysilane is a treatment in which in purified bentonite, alkyltrialkoxysilane is added to a hydrophilic hydroxyl group existing in the surface of bentonite and makes the surface hydrophobic in part. Thereby, dispersed particles of modified bentonite which has been surface treated in an aqueous dispersion system are associated in virtue of a hydrophobic group to form a plastic structure, resulting in remarkable increase in apparent viscosity of the system.

That is, it is estimated that when bentonite (montmorillonite) surface treated with alkyltrialkoxysilane expressed by the above formula (V) is used in the above surface conditioner, an excellent thickening property can be exerted through the effect as described above. It is also estimated that as a result of those mentioned above, it is possible to prevent zinc phosphate particles more from precipitating not only in the surface conditioner but also in the concentrated solution of the surface conditioner, and therefore it is possible to retain the long-range stability of dispersion of the concentrated solution more. And, it is estimated that since the zinc phosphate particles in the concentrated solution of the surface conditioner can be more stabilized, it is possible to attain finer zinc phosphate particles in dispersing the ingredients such as zinc phosphate particles and to improve the dispersion efficiency more.

As a commercially available product of the above bentonite (montmorillonite) surface treated with alkyltrialkoxysilane expressed by the above formula (V), there can be given, for example, BEN-GEL-SH (produced by HOJUN Co., Ltd.).

The above-mentioned BEN-GEL-SH forms a patchwork structure as shown in FIG. 1 as distinct from a card house structure which conventional montmorillonite forms in water. Since this patchwork structure is formed by associating laminar crystal particles of montmorillonite with a plane, it can exert outstanding high viscosity and thixotropy in the surface conditioner of the present invention. That is, among the above bentonite (montmorillonite) surface treated with alkyltrialkoxysilane expressed by the above formula (V), a substance having such a patchwork structure is particularly preferred because it exerts the effect described above more.

In the above surface conditioner, a content of the above laminar clay minerals is preferably within a range of 3 ppm (lower limit) to 600 ppm (upper limit). When the content is less than 3 ppm, a sufficient effect of anti-settling of the zinc phosphate particles in the surface conditioner may not be attained. When it is more than 600 ppm, adsorption of the clay minerals to a metal surface may occur and this adsorption may have an effect on a subsequent chemical conversion treatment step. More preferably, the above lower limit is 10 ppm and the above upper limit is 300 ppm.

The above surface conditioner preferably contains a bivalent or trivalent metal nitrite compound. Since the surface conditioning is usually applied to a clean metal surface after degreasing and rinsing, problems such as oxidation or corrosion of the metal surface may occur during a surface conditioning step, but when the surface conditioner contains a bivalent or trivalent metal nitrite compound, the formation of rust on the metal surface after the surface conditioning can be adequately suppressed. As a result of suppression of rust, a chemical conversion property in a chemical conversion treatment can be greatly improved.

The above-mentioned bivalent or trivalent metal nitrite compound is not particularly limited as long as it is nitrite containing bivalent or trivalent metal, and for example, zinc nitrite, copper nitrite, nickel nitrite, and alkaline earth metal nitrite such as magnesium nitrite, calcium nitrite, strontium nitrite, barium nitrite and the like can be given. Among others, zinc nitrite is preferred. When zinc nitrite is used in a surface conditioning, a bath control of a chemical conversion treatment solution become easy since zinc nitrite prevents a heterogeneous metal from accumulating in a chemical conversion treatment bath during forming a chemical conversion coat of zinc phosphate in a chemical conversion treatment step. And, the formation of rust on the metal surface after the surface conditioning can be more suppressed. These may be used alone or in combination of two or more species.

The above surface conditioner preferably has a bivalent or trivalent metal nitrite compound content of 20 ppm (lower limit) to 1000 ppm (upper limit). When the content is less than 20 ppm, the rust-preventive property and the metal substitution of the surface conditioner may not be well found. When the content is more than 1000 ppm, it is necessary to add a large amount of alkaline components such as caustic soda to the surface conditioner and it is uneconomical. More preferably, the above lower limit is 40 ppm and the above upper limit is 300 ppm.

The above surface conditioner may contain a dispersing medium to disperse zinc phosphate particles. As the above-mentioned dispersing medium, there is given a water-borne medium which contains water in an amount 80% by weight or more, and in addition various organic solvents can be used as a medium other than water. However, the content of the organic solvents is preferably reduced, it is preferably 10% by weight or less, more preferably 5% by weight or less with respect of the water-borne medium. In accordance with the present invention, there can be used a dispersion not containing any dispersing medium other than water.

A water-soluble organic solvent is not particularly limited and alcoholic solvents such as methanol, isopropanol, ethylene glycol, ethylene glycol monopropyl ether and the like; hydrocarbon solvents such as hexane, heptane, xylene, toluene, cyclohexane, naphtha and the like; ketonic solvents such as methyl isobutyl ketone, methyl ethyl ketone, isophorone, acetophenone and the like; amide solvents such as dimethylacetamide, methylpyrrolidone, and the like; and ester solvents such as ethyl acetate, isobutyl acetate, octyl acetate, ethylene glycol acetate monomethyl ether, diethylene glycol acetate monomethyl ether and the like can be given. These may be used alone or in combination of two or more species.

A thickener may be added to the above surface conditioner as required in order to further improve the stability.

The above-mentioned thickener is not particularly limited and inorganic thickeners such as kaolin, diatomaceous earth, calcium carbonate, barium sulfate, titanium oxide, alumina white, silica, aluminum hydroxide and the like, organic thickeners such as polyacrylate, polyurethane, polyester, polyethylene, polypropylene, polyvinyl chloride, polyvinylidene chloride, polystyrene, polysiloxane, thickened polysaccharides, phenol resin, epoxy resin, benzoguanamine resin and the like or thickeners consisting of polymer thereof can be given. These may be used alone or in combination of two or more species.

With respect to use of the above thickener, the species and the amount of the thickener to be added may be appropriately selected. A content of the above thickener is generally within a range of 0.01% by weight (lower limit) to 10% by weight (upper limit) with respect to 100% by weight of the surface conditioner. The above lower limit is preferably 0.1% by weight and the above upper limit is preferably 5% by weight. Further, an antifoaming agent may be used for the purposes of inhibiting foams in works and an antiseptics or a fungicide may be used for the purposes of antisepticising or mold-protecting of a dispersion. With respect to use of them, the species and the amount of the agents to be added may be appropriately selected.

An alkaline salt such as soda ash may be added to the above surface conditioner for the purpose of further stabilizing the zinc phosphate particles and forming a fine chemical conversion coat in a subsequent chemical conversion treatment step of a phosphate coat.

The above surface conditioner has a pH of 3 (lower limit) to 12 (upper limit), respectively. When the pH is less than 3, zinc phosphate particles become apt to dissolve and unstable and this may have an effect on a subsequent step. When it is more than 12, this results in the reduction of pH in a chemical conversion bath of the subsequent step and therefore an effect of a chemical conversion defect may be found. Preferably, the above lower limit is 6 and the above upper limit is 11.

The surface conditioner of the present invention can be produced, for example, by the following method.

The above zinc phosphate particles can be obtained using, for example, zinc phosphate to be used as a raw material. Zinc phosphate of a raw material is one expressed by $Zn_3(PO_4)_2.4H_2O$ and generally a colorless crystalline solid matter, but a white powdery commercial product is available.

As a method of producing the above zinc phosphate of a raw material, there is given, for example, a method in which a tetrahydrate of zinc phosphate is produced as a crystalline precipitation by mixing zinc sulfate and a diluent of disodium hydrogen phosphate in a molar ratio of 3:2 and heating the mixture. And, a tetrahydrate of zinc phosphate can also be produced by reacting a dilute aqueous solution of phosphoric acid with zinc oxide or zinc carbonate. A crystal of tetrahydrate is a rhombic system and has three transformations. When the crystal is heated, it becomes dihydrate at 100° C., monohydrate at 190° C., and anhydride at 250° C. As the zinc phosphate in the present invention, any of these tetrahydrate, dihydrate, monohydrate or anhydride is applicable, but it is adequate to use tetrahydrate, which is generally available, as-is.

And, as the above zinc phosphate of a raw material, substances to which various surface treatments are applied may be used. For example, zinc phosphate surface treated with a silane coupling agent, rosin, a silicone compound, or metal alkoxide such as silicon alkoxide and aluminum alkoxide may be used.

It is known that zinc phosphate brought into fine particles can be obtained by adding silica and polyphosphoric acid in reacting a zinc compound with phosphoric acid from Japanese Kokoku Publication Sho-49-2005, and that metals such as magnesium, calcium, aluminum, etc. can be substituted for part of zinc in zinc phosphate by wet-kneading zinc phosphate and various metal compounds with a mechanical means and completing a reaction mechnochemically from Japanese Kokai Publication Hei-4-310511, and zinc phosphate in which any of components such as silica, calcium and aluminum other than phosphorus, oxygen and zinc is introduced by such a means or a substance which is commercially available as silicic acid modified zinc phosphate may be used. In this case, it is preferred that these substance contain zinc phosphate in an amount 25% by weight or more on a base of ZnO and 15% by weight or more on a base of $P_2O_5$.

A configuration of the above zinc phosphate of a raw material is not particularly limited and any form of zinc phosphate can be used. A commercial product is generally white and powdery, but the powder in any form, such as a fine particle, a plate, a scale, etc., may be used. A particle diameter of the above zinc phosphate of a raw material is also not particularly limited, but an average particle diameter is generally on the order of several μm. Particularly, substances commercially available as rust-preventive pigment such as products of which buffering actions are enhanced by applying a treatment for providing a basic property are suitably employed. Since as table dispersion, in which zinc phosphate particles are dispersed finely, can be prepared in the present invention as described later, a stable effect of surface treatment can be attained without being affected by a primary particle diameter and a form as zinc phosphate of a raw material.

It is preferred to use the zinc phosphate of a raw material which has been fractionated finely by previously bringing the zinc phosphate of a raw material into a dispersion. A method of preparing a water-borne dispersion, formed by dispersing the zinc phosphate particles in a water-borne medium, is not particularly limited, but preparation of the water-borne dispersion can be attained preferably by blending the zinc phosphate of a raw material in the above-mentioned dispersing medium such as water or an organic solvent and wet milling in the presence of the carboxylate group-containing copolymer, the polyamino acid and the phosphate ester, as described above. Further, on the occasion of obtaining the above water-borne dispersion of zinc phosphate particles, it is favorable for a process to blend the zinc phosphate of a raw material in the water-borne medium in preparing a dispersion and to conduct wet-milling, but the water-borne dispersion of zinc phosphate particles may be prepared by conducting solvent substitution after conducting wet-milling in a dispersing medium other than the water-borne medium.

In the above-mentioned preparation of the water-borne dispersion, it is preferred that an amount of the above zinc phosphate of a raw material to be blended is generally within a range of 0.5% by weight (lower limit) to 50% by weight (upper limit) with respect to 100% by weight of a dispersion. When this amount is less than 0.5% by weight, a sufficient effect of the surface conditioner obtained using the dispersion may not be attained since the content of zinc phosphate is too small. When it is more than 50% by weight, it may become difficult to yield a uniform and fine particle size distribution and to form a state of fine dispersion by wet-milling. More preferably, the above lower limit is 1% by weight and the above upper limit is 40% by weight.

Further, in the above preparation of the water-borne dispersion, it is preferred that an amount of the above carboxylate group-containing copolymer, the above polyamino acid and the above phosphate ester to be added is within a range of 0.1% by weight (lower limit) to 50% by weight (upper limit) with respect to 100% by weight of the dispersion. When this amount is less than 0.1% by weight, dispersibility may be insufficient. When it is more than 50% by weight, dispersibility may become poor due to an interaction between excessive carboxylate group-containing copolymers, and even when the dispersibility is sufficient, it is economically disadvantageous. More preferably, the above lower limit is 0.5% by weight and the above upper limit is 20% by weight.

A method of obtaining a dispersion, in which the above zinc phosphate particles are dispersed finely in such a way that $D_{50}$ of the zinc phosphate particles is 3 μm or less, is not particularly limited, but it is preferred that zinc phosphate of a raw material is added to a dispersing medium so as to exist at the content of 0.5 to 50% by weight, and the above carboxylate group-containing copolymer, the above polyamino acid and the above phosphate ester are added to the dispersing medium so as to exist at the content of 0.1 to 50% by weight and the resulting mixture is wet-milled. A method of the above-mentioned wet milling is not particularly limited and usual means of wet milling may be employed, and for example, a beads mill represented by, for example, a disc type and a pin type and a medialess disperser represented by a high pressure homogenizer and an ultra sonic disperser may be used.

In the above wet milling, by monitoring $D_{90}$ of the zinc phosphate particles, the phenomenon of excessive dispersion and the phenomena of the flocculation of particles, the increase in viscosity of a solution and the mutual flocculation of fine particles can be prevented. In the present invention, it is preferred to adjust $D_{90}$ to 4 μm or less. And it is preferred to select the formulation and the dispersion conditions of the level of not producing excessive dispersion.

By the method of preparing a dispersion described above, the $D_{50}$ of zinc phosphate in the water-borne medium can bead justed to 3 μm or less and the water-borne dispersion having the excellent stability and having the excellent performance as the surface conditioner can be obtained. $D_{50}$ can be generally adjusted to a desired extent within a range of 0.01 to 3 μm.

It is possible to disperse zinc phosphate in a state that $D_{50}$ is 3 μm or less in a solution even though a particle diameter of zinc phosphate is 3 μm or more by preparing the water-borne dispersion according to the method of preparing a dispersion described above. The same holds true with regard to zinc phosphate having a primary particle diameter of several tens μm. This also means that a primary particle diameter of pigment can be reduced by wet milling according to the method described above even though zinc phosphate originally having a small primary particle diameter is not used. In accordance with the above method, the $D_{50}$ of zinc phosphate particles in the water-borne dispersion can also be adjusted to 3 μm or less, further 1 μm or less, and furthermore 0.2 μm or less.

The dispersion thus obtained is a water-borne dispersion which can adjust the $D_{50}$ of zinc phosphate particles in a solution to 3 μm or less in conformity with use and has the excellent stability of dispersion and the excellent performance as the surface conditioner.

Since a portion of coarse particles, which are represented as a particle having a particle diameter exceeding $D_{90}$, can be reduced by the above wet milling process, it is possible to prepare a dispersion particularly having a narrow distribution of a dispersion diameter in which large dispersion diameters are restricted such as $D_{90}$ of 4 μm or less, further 2.6 μm or less, furthermore 0.3 μm or less as a distribution of dispersion diameters. Thus, it is estimated that the zinc phosphate is dispersed with fine dispersion diameters and has an extremely stable dispersion condition. Further, it is estimated from a small portion of coarse particles that the zinc phosphate in a solution efficiently contributes to produce crystal nuclei, estimated from a narrow distribution of a dispersion diameter and uniform particle diameters that in a surface conditioning step, more uniform crystal nuclei are formed to provide the formation of uniform zinc phosphate crystals by a subsequent chemical conversion treatment and therefore surface properties of the resulting steel sheet subjected to chemical conversion treatment become homogeneous and excellent, and estimated that this improves treating properties for pockets of members having a complicated structure or a steel sheet such as black coat steel, which is difficult to be chemical conversion treated.

In addition, the $D_{50}$ and $D_{90}$ of zinc phosphate in the dispersion can be determined by measuring a particle size distribution using a laser Doppler type particle size analyzer.

With respect to the above water-borne dispersion, it is also possible to attain a high concentration of water-borne dispersion in which particularly, zinc phosphate is blended in an amount 10% by weight or more, further 20% by weight or more, and furthermore 30% by weight or more. Therefore, the surface conditioner exhibiting high performance can be readily prepared.

The surface conditioner of the present invention can be prepared, for example, by mixing the water-borne dispersion obtained in a manner described above and other components (carboxylate group-containing copolymer, polyamino acid, phosphate ester, laminar clay minerals, bivalent or trivalent metal nitrite compounds, a dispersing medium and a thickener, etc.). A method of mixing the above water-borne dispersion and the above other components is not particularly limited and for example, a method of adding the other components to the water-borne dispersion and then mixing the mixture may be employed, or a method of blending the other components in the water-borne dispersion under being prepared may be employed.

A method of a surface conditioning of the present invention comprising the step of bringing the above surface conditioner into contact with a metal surface. This allows fine particles of zinc phosphate to adhere well to the surface of a metal such as iron-based, zinc-based and aluminum-based metal and a good chemical conversion coat can be formed in a chemical conversion treatment step. Particularly, a better chemical conversion can be formed on the portion of the aluminum-based substrate in the contact area between an iron-based or zinc-based substrate and an aluminum-based substrate. And, a chemical conversion coat of a more sufficient coat amount can be formed for an aluminum-based substrate and a high tensile strength steel sheet.

A method of bringing the surface conditioner into contact with a metal surface in the above-mentioned method of a surface conditioning is not particularly limited and conventional methods publicly known, such as immersion, spraying, etc., can be appropriately employed.

Metal materials, to which the above-mentioned surface conditioning is applied, are not particularly limited and the surface conditioning can be applied to various materials to which the chemical conversion treatment of phosphate is generally applied, for example, steel, galvanized steel sheet, aluminum or aluminum alloy and magnesium alloy. This method can also be suitably applied to the contact area between a steel sheet or a galvanized steel sheet and aluminum or aluminum alloy.

And, it is possible to use the surface conditioner of the present invention for a step of degreasing-cum-surface conditioning. Thereby, a rinsing step after degreasing can be omitted. In order to enhance detergency, publicly known inorganic alkali builders, organic builders and surfactants may be added in the above degreasing-cum-surface conditioning. And, publicly known chelate agent and condensed phosphate may be added. In the above surface conditioning, a contact time between the surface conditioner and the metal surface and a temperature of the surface conditioner are not particularly limited and publicly known conditions can be employed.

It is possible to manufacture a steel sheet subjected to the chemical conversion treatment of phosphate by conducting the above surface conditioning and then conducting chemical conversion treatment of phosphate.

A method of the above chemical conversion treatment of phosphate is not particularly limited and various publicly known methods such as dipping, spraying, electroplating, etc. can be applied. These methods may be used in combination. With respect to a phosphate coat to be precipitated, it is not particularly limited as long as it is phosphate, and zinc phosphate, iron phosphate, manganese phosphate, and zinc calcium phosphate are not restricted at all. In the above chemical conversion treatment of phosphate, a contact time between the chemical conversion treatment agent and the metal surface and a temperature of a chemical conversion treatment agent are not particularly limited and publicly known conditions can be employed.

It is possible to manufacture a coated steel sheet by further coating after conducting the above surface conditioning and the above chemical conversion treatment. As a method of the above coating, an electrodeposition is popular. A coating composition to be used in coating is not particularly limited and various coating compositions generally used in coating a steel sheet subjected to chemical conversion treatment of phosphate, for example epoxy melamine coating composition, cationic electrocoating composition, polyester intermediate coating composition, polyester top coating composition, etc. can be given. In addition, a publicly known method that a cleaning step is performed prior to coating is employed after chemical conversion treatment.

The surface conditioner of the present invention contains zinc phosphate particles having $D_{50}$ of 3 μm or less and at least one species selected from the group consisting of the specific carboxylate group-containing copolymers, the polyamino acids and the phosphate esters and has a pH of 3 to 12. Thereby, when the surface conditioning is applied to a substrate having an area where the iron-based or zinc-based substrate and the aluminum-based substrate are in contact with each other using the above surface conditioner and then chemical conversion treatment is conducted, a good chemical conversion coat can be formed on the portion of the aluminum-based substrate in the contact area. And, when it is applied to an aluminum alloy and a high tensile strength steel sheet, a sufficient chemical conversion coat can be formed. Further, since the surface conditioner of the present invention contains specific components, it can promote significantly the formation of a chemical conversion coat and form a dense chemical conversion coat, and since it contains zinc phosphate particles having $D_{50}$ of 3 μm or less, it has the excellent stability of dispersion in a bath. Accordingly, the above surface conditioner can be suitably used for the surface conditioning of various metal materials.

Since the surface conditioner of the present invention is constructed as described above, it can form a sufficient chemical conversion when applied to an aluminum alloy and a high tensile strength steel sheet and has the excellent stability of dispersion in a treatment bath and can inhibit galvanic corrosion on an aluminum alloy during chemical conversion treatment. Accordingly, the above surface conditioner can be suitably used for various metal materials, particularly substrates having a contact area between an iron-based or zinc-based substrate and an aluminum-based substrate.

BEST MODES FOR CARRYING OUT THE INVENTION

Hereinafter, the present invention will be described in more detail by way of examples, but the present invention is not limited to these examples. In addition, "part(s)" and "%" refer to "part(s) by weight" and "% by weight" in Examples, unless otherwise specified.

EXAMPLE 1

Preparation of Surface Conditioner

Natural hectorite "BENTON EW" (produced by ELEMENTIS PLC) 0.3 parts by weight was added to 87.7 parts by weight of water and this mixture was stirred for 30 minutes at a rotational speed of 3000 rpm using a disper to obtain pre-gel. To the resulting pre-gel, 2 parts by weight of commercially available "ARON A6020" (carboxylate group-containing copolymer of acrylic acid of 40% by weight-sulfonic acid of 60% by weight, produced by TOAGOSEI CO., LTD.) and 10 parts by weight of zinc phosphate particles were added, and zinc phosphate particles in this mixture were dispersed with zirconia beads until a predetermined viscosity was reached. Further, the resulting dispersion was diluted with water and the diluted solution was adjusted to pH 9.5 with caustic soda to obtain a surface conditioner (concentration of zinc phosphate particles 1500 ppm, concentration of carboxylate group-containing copolymer 60 ppm, concentration of natural hectorite 45 ppm).

EXAMPLE 2

Preparation of Surface Conditioner

A surface conditioner was obtained by following the same procedure as in Example 1 except for using 2.7 parts by weight of "AQUADEW SPA-30" (sodium polyaspartate produced by Ajinomoto-Fine-Techno Co., Inc.) in place of 2 parts by weight of "ARON A6020" (concentration of zinc phosphate particles 1500 ppm, concentration of sodium polyaspartate 60 ppm, concentration of natural hectorite 45 ppm).

EXAMPLE 3

Preparation of Surface Conditioner

A surface conditioner was obtained by following the same procedure as in Example 1 except for using 1.6 parts by weight of "EFKA-4550" (carboxylate group-containing copolymer of acrylic acid of 35% by weight-tertiary-amine of 65% by weight, produced by EFKA Additives B.V.) in place of 2 parts by weight of "ARON A6020" (concentration of zinc phosphate particles 900 ppm, concentration of carboxylate group-containing copolymer 60 ppm, concentration of natural hectorite 45 ppm).

EXAMPLE 4

Preparation of Surface Conditioner

A surface conditioner was obtained by following the same procedure as in Example 1 except for using 2.1 parts by weight of "POLYSTAR OM" (carboxylate group-containing copolymer of maleic acid of 40% by weight-diisobutylene of 60% by weight, produced by NOF CORPORATION) in place of 2 parts by weight of "ARON A6020" (concentration of zinc phosphate particles 1500 ppm, concentration of carboxylate group-containing copolymer 60 ppm, concentration of natural hectorite 45 ppm).

EXAMPLE 5

Preparation of Surface Conditioner

A surface conditioner was obtained by following the same procedure as in Example 1 except for using 3.2 parts by weight of "PHOSPHANOL RS-610" (polyoxyethylene alkyl phosphate, produced by TOHO Chemical Industry Co., LTD) in place of 2 parts by weight of "ARON A6020" (concentration of zinc phosphate particles 1500 ppm, concentration of polyoxyethylene alkyl phosphate 120 ppm, concentration of natural hectorite 45 ppm).

EXAMPLE 6

Preparation of Surface Conditioner

A surface conditioner was obtained by following the same procedure as in Example 1 except for using 1.4 parts by weight of "SMA 1440H" (carboxylate group-containing copolymer of maleic acid less than 50% by weight-styrene more than 50% by weight, produced by Sartomer Company, Inc.) in place of 2 parts by weight of "ARON A6020" (concentration of zinc phosphate particles 1500 ppm, concentration of carboxylate group-containing copolymer 60 ppm, concentration of natural hectorite 45 ppm).

EXAMPLE 7

Preparation of Surface Conditioner

A surface conditioner was obtained by following the same procedure as in Example 1 except for using 2.1 parts by weight of "MALIALIM AKM0531" (carboxylate group-containing copolymer of maleic acid plus acrylic acid less than 50% by weight-polyethylene more than 50% by weight, produced by NOF CORPORATION) in place of 2 parts by weight of "ARON A6020" (concentration of zinc phosphate particles 1500 ppm, concentration of carboxylate group-containing copolymer 60 ppm, concentration of natural hectorite 45 ppm).

EXAMPLE 8

Preparation of Surface Conditioner

A surface conditioner was obtained by following the same procedure as in Example 1 except for using 1.3 parts by weight of "JONCRYL 60" (carboxylate group-containing copolymer of acrylic acid of 30% by weight-styrene of 70% by weight, produced by JOHNSON POLYMER CORPORATION) in place of 2 parts by weight of "ARON A6020" (concentration of zinc phosphate particles 1500 ppm, concentration of carboxylate group-containing copolymer 60 ppm, concentration of natural hectorite 45 ppm).

COMPARATIVE EXAMPLE 1

Preparation of Surface Conditioner

Using a surface conditioner "SURFFINE 5N-8" (Ti base) (produced by NIPPON PAINT Co., Ltd.), water was added to this surface conditioner to adjust to the predetermined concentration (diluent of 0.1% by weight).

COMPARATIVE EXAMPLE 2

Preparation of Surface Conditioner

A surface conditioner was obtained by following the same procedure as in Example 1 except for using 0.8 parts by weight of a nonionic surfactant "EMULGEN 103" (produced by Kao Corporation) in place of 2 parts by weight of "ARON A6020" (concentration of zinc phosphate particles 1500 ppm, concentration of a nonionic surfactant 120 ppm, concentration of natural hectorite 45 ppm).

COMPARATIVE EXAMPLE 3

Preparation of Surface Conditioner

A surface conditioner was obtained by following the same procedure as in Example 1 except for using 4 parts by weight of ammonium salt of polyacrylic acid homopolymer "SN-Dispersant 5027" (produced by SAN NOPCO LTD.) in place of 2 parts by weight of "ARON A6020" (concentration of zinc phosphate particles 1500 ppm, concentration of ammonium salt of polyacrylic acid homopolymer 120 ppm, concentration of natural hectorite 45 ppm).

COMPARATIVE EXAMPLE 4

Preparation of Surface Conditioner

A surface conditioner was obtained by following the same procedure as in Example 1 except for using 2 parts by weight of sodium salt of polyacrylic acid homopolymer "SN-Dispersant 5034" (produced by SAN NOPCO LTD.) in place of 2 parts by weight of "ARON A6020" (concentration of zinc phosphate particles 1500 ppm, concentration of sodium salt of polyacrylic acid homopolymer 120 ppm, concentration of natural hectorite 45 ppm).

COMPARATIVE EXAMPLE 5

Preparation of Surface Conditioner

A surface conditioner was obtained by following the same procedure as in Example 1 except for using 2 parts by weight of polymer of methacrylic acid of 50% by weight-styrenesulfonic acid of 50% by weight in place of 2 parts by weight of "ARON A6020" (concentration of zinc phosphate particles 1500 ppm, concentration of polymer of methacrylic acid of 50% by weight-styrenesulfonic acid of 50% by weight 120 ppm, concentration of natural hectorite 45 ppm).

[Preparation 1 of Test Sheet]

Each of cold-rolled steel sheet (SPC) (70 mm×150 mm×0.8 mm), aluminum steel sheet (#6000 series) (70 mm×150 mm×0.8 mm), galvanized steel sheet (GA) (70 mm×150 mm×0.8 mm) and high tensile strength steel sheet (70 mm×150 mm×1.0 mm) was degreased at 40° C. for 2 minutes with "SURFCLEANER EC92" (degreasing agent produced by NIPPON PAINT Co., Ltd.) and then subjected to a surface conditioning treatment at room temperature for 30 seconds using the surface conditioners obtained in Examples and Comparative Examples.

Subsequently, each sheet was subjected to the chemical conversion treatment at 35° C. for 2 minutes through an immersion technique using a zinc phosphate treatment solution ("SURFDYNE SD-6350" produced by NIPPON PAINT Co., Ltd.), and rinsed with water, rinsed with pure water and dried to obtain a test sheet.

[Preparation 2 of Test Sheet]

Aluminum steel sheets and galvanized steel sheets, which had been subjected to a surface conditioning treatment in the same manner as in Preparation 1 of test sheet described above, were prepared and the aluminum steel sheet and the galvanized steel sheet after the surface conditioning treatment were connected to each other with a clip. Then, chemical conversion treatment, rinsing with water, rinsing with pure water and drying were applied to the connected steel sheet in the same manner as in Preparation 1 of test sheet to obtain a test sheet.

[Evaluation Test]

Evaluation tests were performed according to the following methods. The test results are shown in Table 1.

Chemical Conversion Property of Zinc Phosphate Coat (Weight of Chemical Conversion Coat (C/W))

(1) Measurement of Weight of Chemical Conversion Coat of SPC Test Sheet

Each test sheet was immersed for 5 minutes in a 50 g/l solution of chromium trioxide heated to 75° C. and its chemical conversion coat was peeled off. A weight of the test sheet obtained in which the coat was not yet peeled off was assumed as A (g) and a weight of the test sheet after peeling off the coat from test sheet by the above procedure was assumed as B (g). The difference between these weights, (A-B) (g), was divided by the surface area of the test sheet to determine the weight of a chemical conversion coat (C/W).

(2) Measurement of Weights of Chemical Conversion Coats of Aluminum Steel Test Sheet and GA Test Sheet The weights of chemical conversion coats were measured using a X-ray fluorescence spectrometer "XRF-1700" (manufactured by Shimadzu Corporation).

Figure 2:
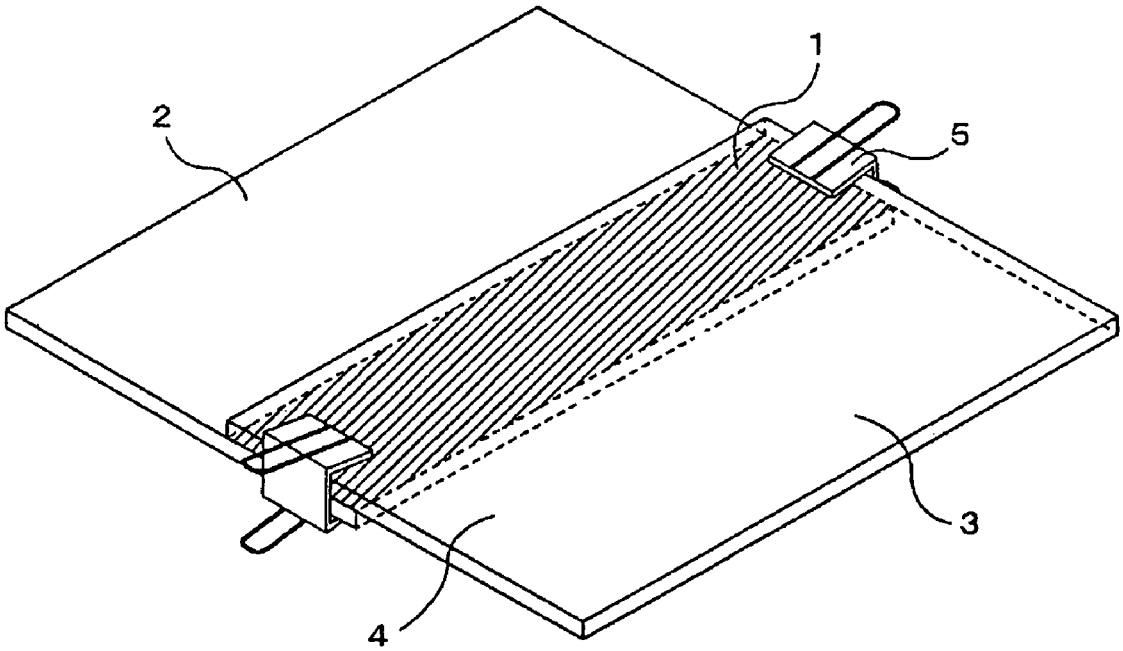
FIG. 2 is a schematic view of the galvanically corroded aluminum test sheets used in Examples.
Figure 3:
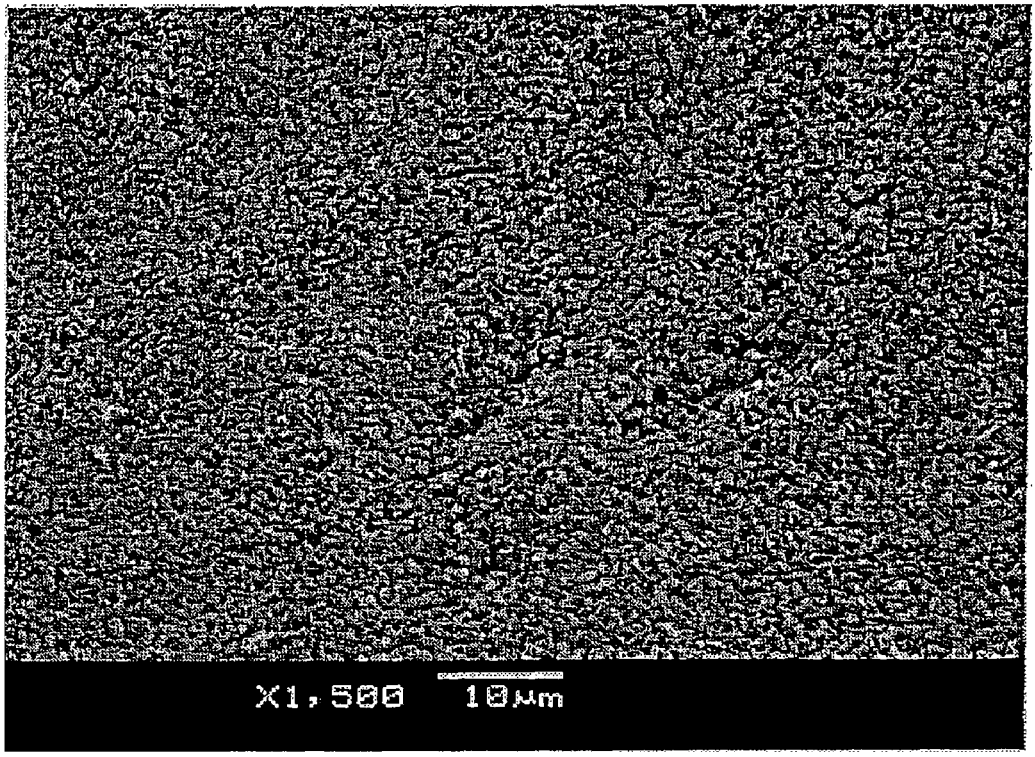
FIG. 3 shows an electron micrograph of a cold-rolled steel sheet (SPC) of Example 1.
Figure 4:
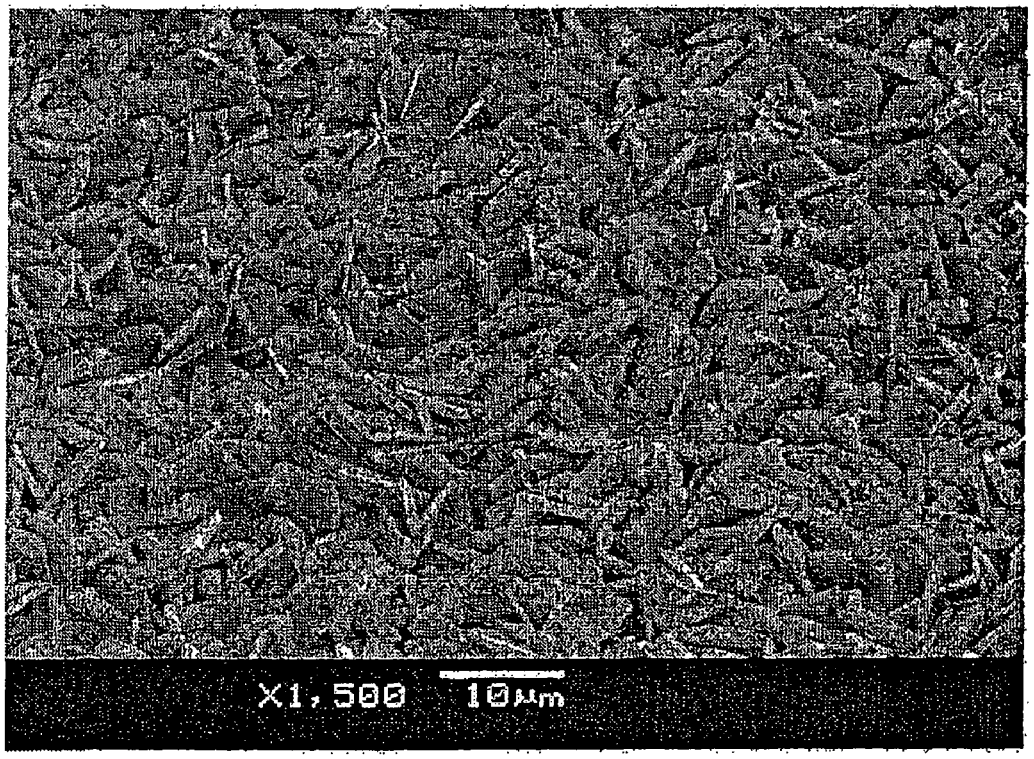
FIG. 4 shows an electron micrograph of a galvanized steel sheet (GA) of Example 1.
Figure 5:
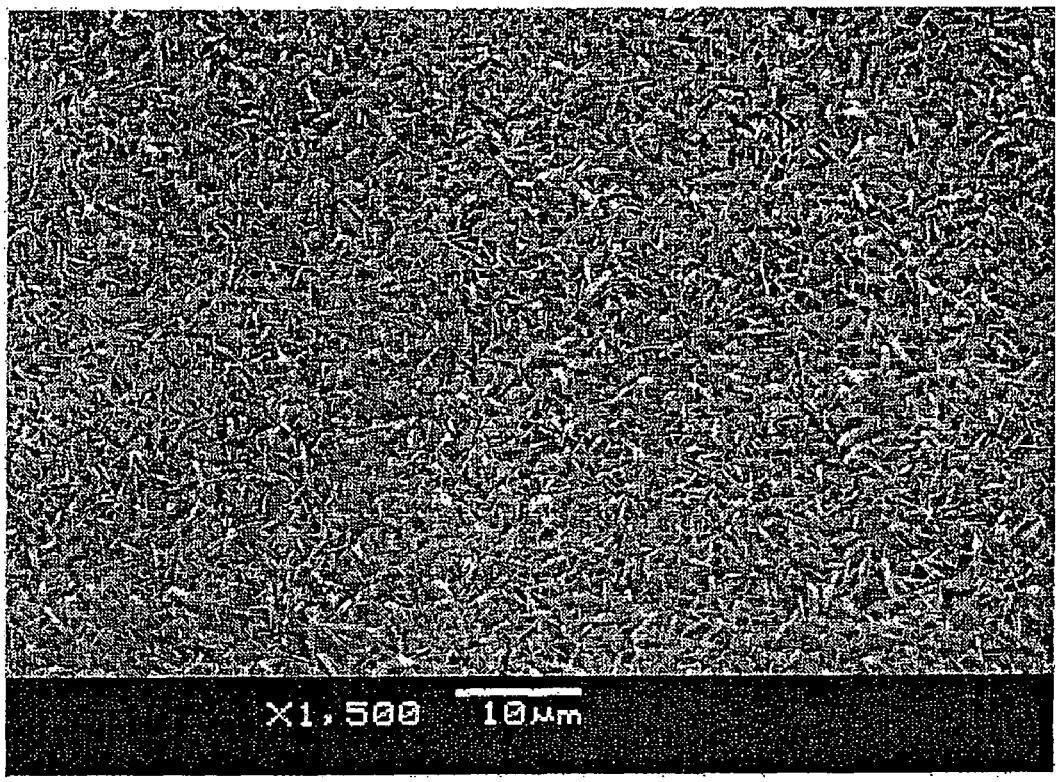
FIG. 5 shows an electron micrograph of an aluminum steel sheet (AL) of Example 1.
Figure 6:
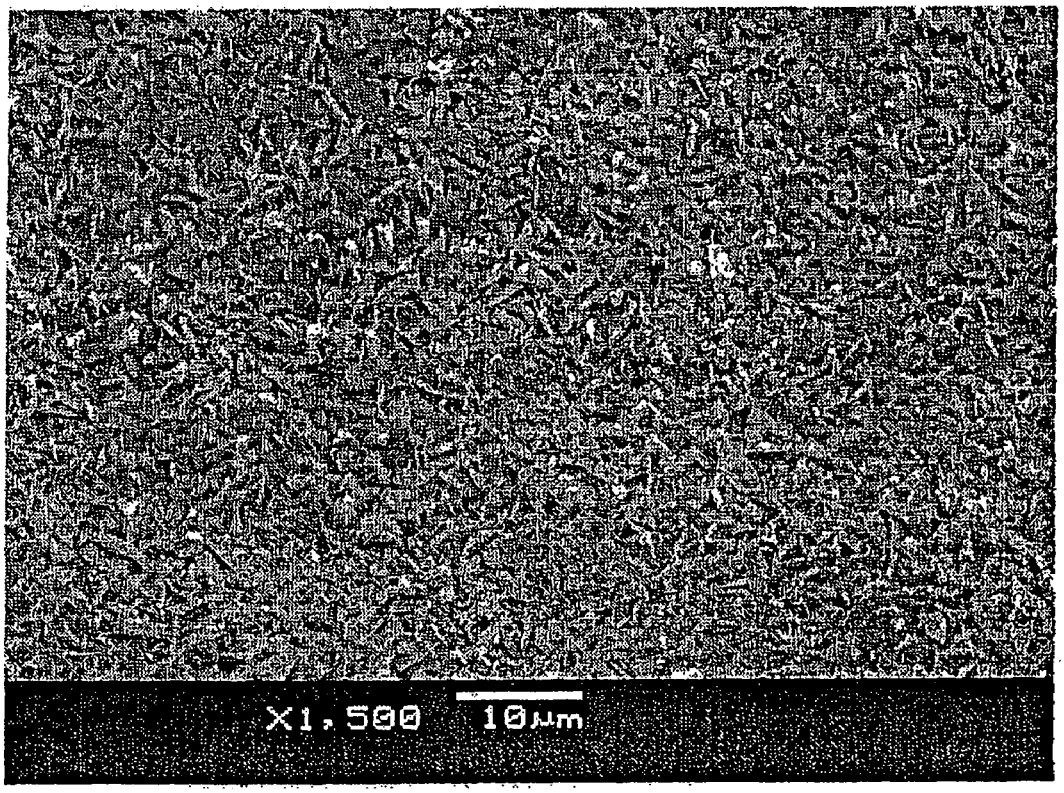
FIG. 6 shows an electron micrograph of a galvanic corrosion area of the aluminum steel sheet of Example 1.
Figure 7:
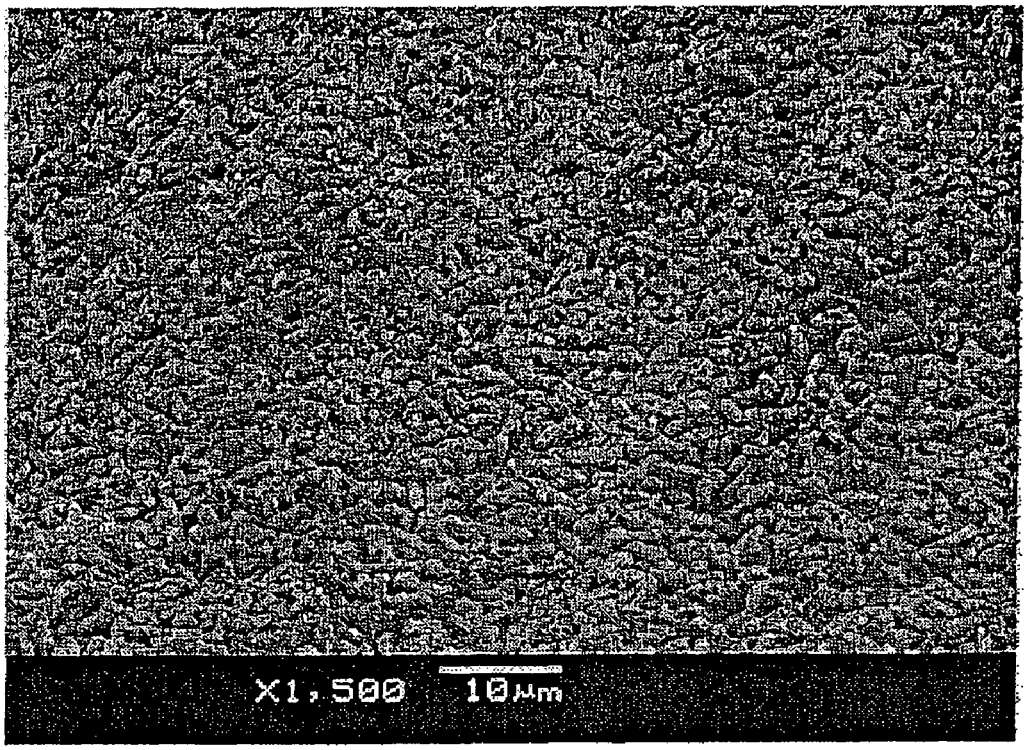
FIG. 7 shows an electron micrograph of SPC of Comparative Example 1.
Figure 8:
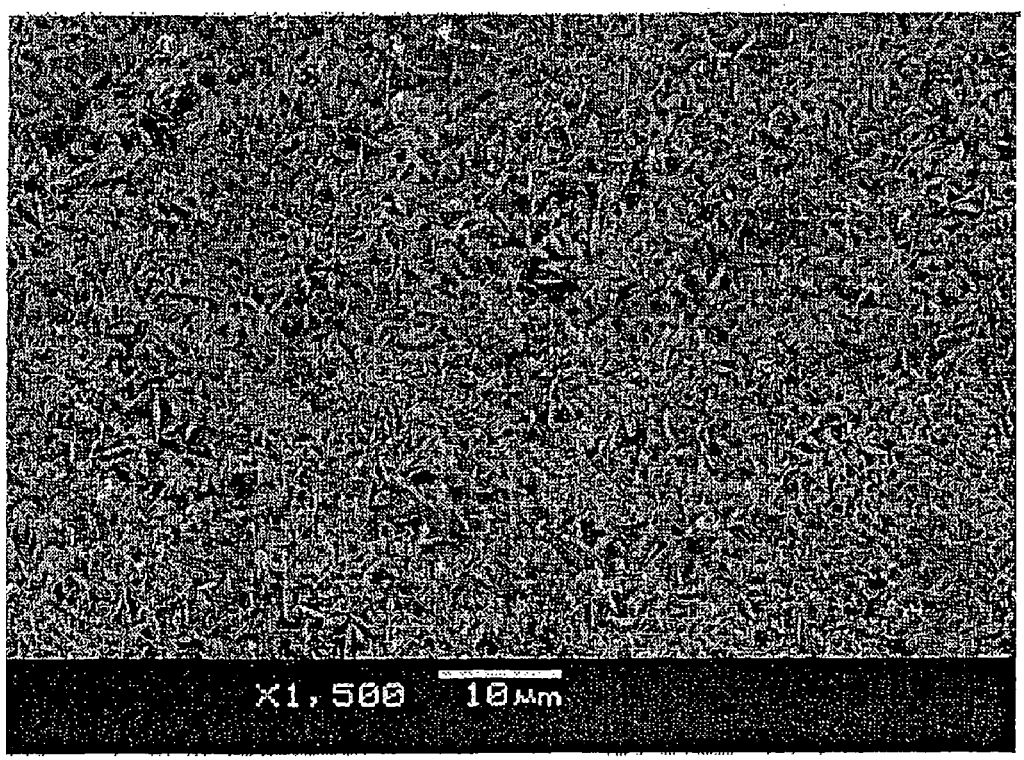
FIG. 8 shows an electron micrograph of GA of Comparative Example 1.
Figure 9:
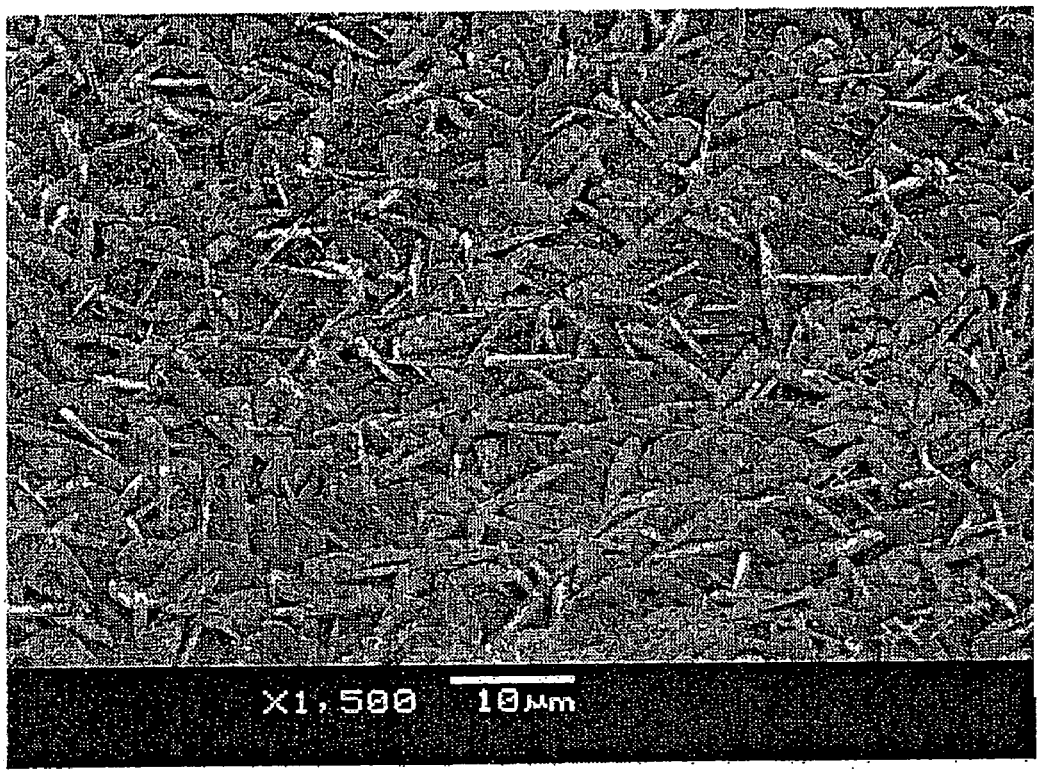
FIG. 9 shows an electron micrograph of AL of Comparative Example 1.
Figure 10:
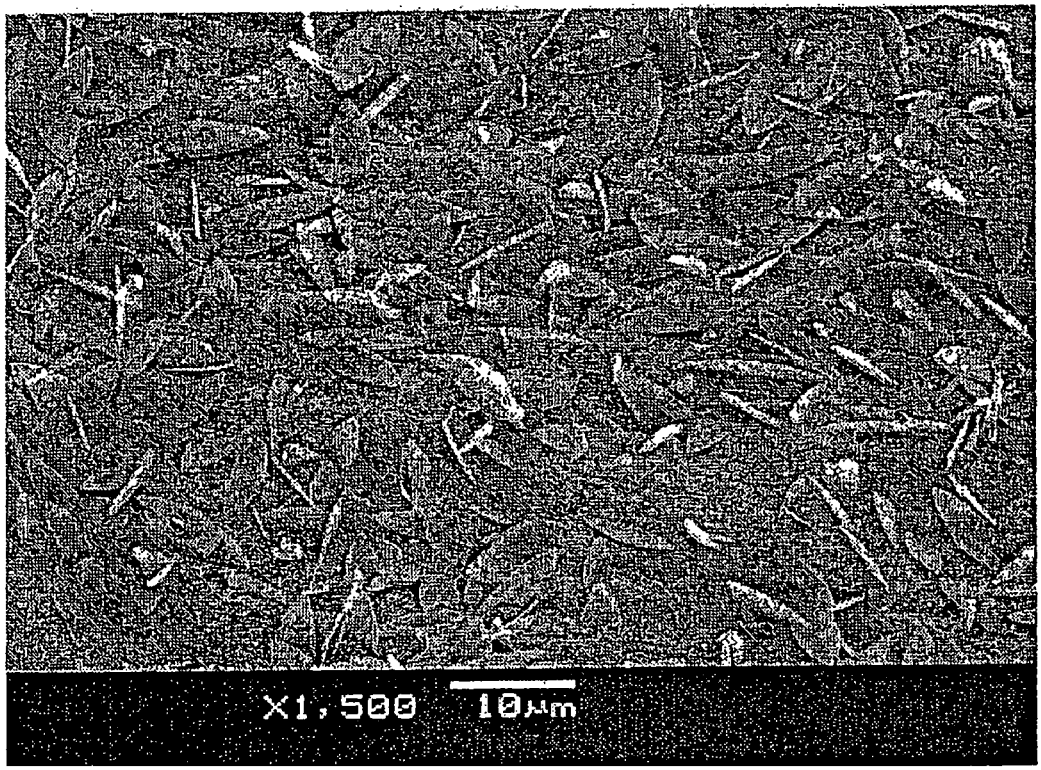
FIG. 10 shows an electron micrograph of a galvanic corrosion area of the aluminum steel sheet of Comparative Example 1.

(3) Measurement of Weight of Chemical Conversion Coat of Galvanically Corroded Aluminum Steel Test Sheet An area of the aluminum steel sheet connected to the galvanized steel sheet was assumed as a galvanic corrosion area and an area of the aluminum steel sheet not connected to the galvanized steel sheet was assumed as a general area, and the amounts of the chemical conversion coats were measured with a X-ray fluorescence spectrometer "XRF-1700" (manufactured by Shimadzu Corporation) Incidentally, a schematic view of the galvanically corroded aluminum steel test sheets is shown in FIG. 2.

(4) Coat Appearance of High Tensile Strength Steel Sheet

The appearances of coats formed were evaluated based on evaluation criteria of "uniform", "partially rusted" and "rusted".

Measurement of Particle Diameter of Zinc Phosphate Particles

Particle size distribution was measured using laser scattering particle size distribution analyzer ("LA-500" manufactured by HORIBA, Ltd.), and $D_{50}$ (an average diameter of dispersed matter) and $D_{90}$ were monitored and measured.

Electronmicrograph of Chemical Conversion Coat of Zinc Phosphate

Electron micrographs of test sheets prepared using the surface conditioners of Example 1 and Comparative Example 1 are shown in FIGS. 3 to 10.

TABLE 1

| | Component | | | | | Amount of cost (g/m$^2$) | | | | Cost apperance High tensile |
|---|---|---|---|---|---|---|---|---|---|---|
| | Structure and amount used | Trade name | Laminar clay mineral | $D_{50}$ | $D_{90}$ | SPC | GA | AL | Galvanically corroded AL | strength steel sheet |
| Example 1 | Polymer of 40 wt % acrylic acid-60 wt % sulfonic acid 60 ppm | ARON A6020 | Natural hectorite 45 ppm | 0.51 μm | 0.98 μm | 1.78 | 2.39 | 1.20 | 1.15 | Uniform |
| Example 2 | Sodium polyaspartate 60 ppm | AQUADEW SPA-30 | Natural hectorite 45 ppm | 0.55 μm | 1.03 μm | 1.75 | 2.43 | 1.19 | 1.07 | Uniform |

TABLE 1-continued

| | Component | | | | | Amount of cost (g/m$^2$) | | | | Cost apperance High tensile |
|---|---|---|---|---|---|---|---|---|---|---|
| | Structure and amount used | Trade name | Laminar clay mineral | $D_{50}$ | $D_{90}$ | SPC | GA | AL | Galvanically corroded AL | strength steel sheet |
| Example 3 | Polymer of 35 wt % acrylic acid-65 wt % tertiary-amine 60 ppm | EFKA4550 | Natural hectorite 45 ppm | 1.81 μm | 2.52 μm | 1.60 | 2.52 | 1.10 | 1.11 | Uniform |
| Example 4 | Polymer of 40 wt % maleic acid-60 wt % diisobutylene 60 ppm | POLYSTAR OM | Natural hectorite 45 ppm | 1.73 μm | 2.38 μm | 1.73 | 2.48 | 1.09 | 1.02 | Uniform |
| Example 5 | Phosphate ester 120 ppm | PHOSPHANOL RS-610 | Natural hectorite 45 ppm | 0.80 μm | 1.93 μm | 1.69 | 2.98 | 1.19 | 1.13 | Uniform |
| Example 6 | Polymer of maleic acid less than 50 wt %-styrene more then 50 wt % 60 ppm | SMA1440H | Natural hectorite 45 ppm | 1.98 μm | 3.02 μm | 1.87 | 3.00 | 1.03 | 1.00 | Uniform |
| Example 7 | Polymer of maleic acid plus acrylic acid less than 50 wt %-polyethylene more than 50 wt % 60 ppm | MALIALIM AKM0531 | Natural hectorite 45 ppm | 2.76 μm | 5.76 μm | 1.83 | 3.02 | 1.00 | 1.00 | Uniform |
| Example 8 | Polymer of 30 wt % acrylic acid-70 wt % styrene 60 ppm | JONCRYL 60 | Natural hectorite 45 ppm | 1.82 μm | 3.11 μm | 1.89 | 2.99 | 1.10 | 1.02 | Uniform |
| Comparative Example 1 | | SURFFINE 5N-8 (Ti-based) | | | | 2.10 | 4.00 | 0.48 | 0.32 | Partially rusted |
| Comparative Example 2 | Nonionic surfactant 120 ppm | | Natural hectorite 45 ppm | 8.72 μm | 20.33 μm | Rusted | 4.29 | 0.35 | 0.21 | Rusted |
| Comparative Example 3 | Ammonium salt of polyacrylic acid homopolymer 120 ppm | | Natural hectorite 45 ppm | 4.63 μm | 14.78 μm | Rusted | 4.68 | 0.29 | 0.19 | Rusted |
| Comparative Example 4 | Sodium salt of polyacrylic acid homopolymer 120 ppm | | Natural hectorite 45 ppm | 7.85 μm | 18.92 μm | Paritally rusted | 4.19 | 0.32 | 0.22 | Partially rusted |
| Compartive Example 5 | Polymer of 50 wt % methacrylic acid-50 wt % styrenesulfonic acid 120 ppm | | Natural hectorite 45 ppm | 5.39 μm | 15.66 μm | Rusted | 4.80 | 0.23 | 0.18 | Rusted |

When the surface conditioners of Examples were used, sufficient chemical conversion coats were formed for all cold-rolled steel sheets, aluminum steel sheets and galvanized steel sheets, and further in each Example, a sufficient chemical conversion coat was also formed on the portion of the aluminum steel sheet in the contact area between the aluminum steel sheet and the galvanized steel sheet.

The surface conditioner of the present invention can be suitably used for various metal materials which are used in automobile's bodies, household electrical appliances and the like.

The invention claimed is:

1. A surface conditioner, containing zinc phosphate particles and having a pH of 3 to 12, wherein said zinc phosphate particles have $D_{50}$ of 3 μm or less, said surface conditioner contains a carboxylate group-containing copolymer and hectorite, and said carboxylate group-containing copolymer is obtained by polymerizing a monomer composition containing acrylic acid in an amount less than 50% by weight, and a sulfonic acid monomer in a total amount more than 50% by weight.

2. The surface conditioner of claim 1, containing zinc phosphate particles and having a pH of 3 to 12, wherein said zinc phosphate particles have $D_{50}$ of 3 μm or less, said surface conditioner contains a carboxylate group-containing copolymer and hectorite, and said carboxylate group-containing copolymer is obtained by polymerizing a monomer composition containing acrylic acid in an amount less than 50% by weight, and at least one of 2-acrylamido-2-methyl propane sulfonic acid or allyl sulfonic acid in a total amount more than 50% by weight.

3. The surface conditioner according to claim 2, wherein the hectorite is a natural hectorite and/or a synthetic hectorite.

4. A method of a surface conditioning, comprising the step of bringing the surface conditioner according to claim 2 or 3 into contact with a metal surface.

* * * * *